US009008347B2

(12) United States Patent
Lee

(10) Patent No.: US 9,008,347 B2
(45) Date of Patent: Apr. 14, 2015

(54) HANDS-FREE DEVICE

(71) Applicant: Youngok Lee, Gainesville, FL (US)

(72) Inventor: Youngok Lee, Gainesville, FL (US)

(73) Assignee: Youngok Lee, Gainesville, FL (US)

( * ) Notice: Subject to any disclaimer, the term of this patent is extended or adjusted under 35 U.S.C. 154(b) by 0 days.

(21) Appl. No.: 13/668,341

(22) Filed: Nov. 5, 2012

(65) Prior Publication Data

US 2014/0037122 A1 Feb. 6, 2014

Related U.S. Application Data

(60) Provisional application No. 61/556,174, filed on Nov. 4, 2011.

(51) Int. Cl.
*H04R 25/00* (2006.01)
*H04R 1/10* (2006.01)

(52) U.S. Cl.
CPC ..... *H04R 1/1041* (2013.01)

(58) Field of Classification Search
USPC ..... 381/370–371, 374–381, 383
See application file for complete search history.

(56) References Cited

U.S. PATENT DOCUMENTS

| | | | | |
|---|---|---|---|---|
| 6,430,299 | B1 * | 8/2002 | Hall et al. | 381/371 |
| 8,009,853 | B2 * | 8/2011 | Ito et al. | 381/381 |
| 8,111,859 | B2 * | 2/2012 | Phillips | 381/376 |

* cited by examiner

*Primary Examiner* — Suhan Ni
(74) *Attorney, Agent, or Firm* — IP & T Group LLP

(57) ABSTRACT

A hands-free device includes upper and lower earphones; a hands-free main body having opened top and bottom surfaces; a control unit mounted in the hands-free main body and configured to apply an operation signal; and an earphone protruding unit formed in the hands-free main body and configured to protrude the upper earphone through a rear surface of the hands-free main body in response to a protrusion operation signal of the control unit; and an earphone drawing unit formed in the hands-free main body and configured to draw one or more of the upper and lower earphones through one or more of the top and bottom surfaces of the hands-free main body in response to a draw operation signal of the control unit.

10 Claims, 18 Drawing Sheets

(a)

(b)

FIXED MODE (d)

(e)

HANDS-FREE DEVICE

This application claims the benefit of U.S. Provisional Application No. 61/556,174, filed on 4 Nov. 2011.

BACKGROUND OF THE INVENTION

1. Field of the Invention

The present invention relates to a hands-free device, and more particularly, to a hands-free device which may be applied in various manners depending on use environments.

2. Description of the Related Art

In general, a hands-free device is wired or wirelessly connected to an electronic device, and serves to transmit data such as user's voice signals to the electronic device and receive data such as voice signals transmitted from the electronic device, without a direct manipulation on the electronic device.

The hands-free device generally includes an output unit such as a circuit and earphone to reproduce received voice signals and an input unit such as a mike and circuit to receive and process voice signals and transmit the processed voiced signals.

In general, the hands-free device is formed in such a manner that the output unit such as an earphone is placed on a user's ear and the input unit such as a mike is positioned adjacent to a user's mouth.

The above-described hands-free device has a standardized basic structure for performing basic input and output functions.

Recently, with the development of electronic and communication technology, the portability of electronic devices has been considered to be important. However, the conventional hands-free device has a functional limit in which it must cover a user's ears and mouth. Therefore, the portability of the hands-free device inevitably decreases due to the standardized structure. Furthermore, the conventional hands-free device has difficulties in connecting with a variety of portable electronic devices launched on the market.

Accordingly, there is an urgent demand for a hands-free device which may be easily connected with various portable electronic devices while strengthening convenience and portability, and may be used for multipurpose in response to various situations.

SUMMARY OF THE INVENTION

An embodiment of the present invention is directed to a hands-free device which may be conveniently used in various manners and easily carried by a user.

Another embodiment of the present invention is directed to a hands-free device which may be utilized for multipurpose in consideration of portable characteristics of the hands-free device.

In accordance with an embodiment of the present invention, a hands-free device includes: an earphone; a hands-free main body; a control unit mounted in the hands-free main body and configured to apply an operation signal; and an earphone protruding unit formed in the hands-free main body and configured to protrude the earphone through a rear surface of the hands-free main body in response to a protrusion operation signal of the control unit.

The hands-free main body may have an earphone protrusion hole formed in the rear surface thereof, through which the earphone is protruded.

The earphone protruding unit may include: a protrusion guide portion formed horizontally inside the hands-free main body and having rails formed in a longitudinal direction thereof; a protrusion movement block having a bottom part coupled to the protrusion guide portion so as to linearly move and a top part coupled to an earphone boss portion; and a horizontal driving unit formed at the bottom part of the protrusion movement block and configured to receive the protrusion operation signal of the control unit and apply a linear moving force to the protrusion movement block.

The top part of the protrusion guide portion may be opened to form a housing space, the rails may be formed to extend horizontally while facing each other inward from both side surfaces, the bottom part of the protrusion guide portion may be housed in the housing space, and the protrusion guide portion may have rail grooves formed in side surfaces thereof, into which the rails are inserted to linearly move the protrusion movement block while restricting the protrusion movement block from moving upward.

The horizontal driving unit may include: a motor having a rotating shaft inserted horizontally inside the bottom part of the protrusion movement block; a rotating rod having one end coupled to the motor shaft and the other end rotatably supported by the bottom inside of the protrusion movement block; a pinion gear having a central portion coupled to the rotating rod so as to transmit torque of the motor; and a horizontal rack bar formed on the bottom surface of the protrusion guide portion and engaged with the pinion gear so as to convert the rotation of the motor into a linear movement.

The pinion gear may have gear teeth formed to protrude downward from the bottom of the protrusion movement block.

A decoration unit may be detachably coupled to a front surface of the hands-free main body.

A coupling unit may be detachably coupled to one side of the hands-free main body.

In accordance with another embodiment of the present invention, a hands-free device includes: an earphone; a hands-free main body having top and bottom surfaces, one or more of which are formed to be opened; a control unit mounted in the hands-free device and configured to apply an operation signal; and an earphone drawing unit configured to draw the earphone through one or more of the top and bottom surfaces of the hands-free main body in response to a draw operation signal of the control unit.

The earphone drawing unit may include: a draw guide portion formed vertically inside a front central portion of the hands-free main body and having rails formed in a longitudinal direction thereof; a draw movement block including a side extended portion coupled to the draw guide portion so as to linearly move and a body portion coupled vertically to the side extended portion and detachably coupled to an earphone boss portion; and a vertical driving unit formed at an end of the side extended portion and configured to receive the draw operation signal of the control unit and apply a linear moving force to the draw movement block.

The top of the draw guide portion may be opened to form a housing space, the rails may be formed to extend vertically while facing each other inward from both side surfaces, and the side extended portion may be housed in the housing space, and may have rail grooves formed in both side surfaces thereof, into which the rails are inserted to linearly move the side extended portion while restricting the side extended portion from moving backward.

The earphone boss portion may include a mike installed to receive an external voice signal.

The vertical driving unit may include: a motor having a rotating shaft inserted horizontally inside an end of the side extended portion; a rotating rod having one end coupled to the motor shaft and the other end rotatably supported by the end inside of the side extended portion; a pinion gear having a central portion coupled to the rotating rod so as to transmit torque of the motor; and a vertical rack bar formed on the bottom surface of the draw guide portion and engaged with the pinion gear so as to convert the rotation of the motor into a linear movement.

The pinion gear may have gear teeth formed to protrude from the end of the side extended portion.

The earphone drawing unit may further include a telescopic unit formed in the draw guide portion and configured to extend and contract the draw guide portion in a vertical direction in response to an extension operation signal of the control unit.

The telescopic unit may include: a multi-step portion having the lowermost part fixed to the hands-free main body, formed along the circumferential surface of the draw guide portion, and coupled to slide in a vertical direction; a rack bar having a bent portion formed of a bendable material, wherein one side of the rack bar based on the bent portion is coupled to move in a vertical direction along the inner surface of the hands-free main body and the other side of the rack bar is fixed and coupled to the bottom inside of the draw guide portion; and an extended driving unit engaged with the bent portion of the rack bar so as to provide a driving force. When the rack bar is vertically moved in connection with the rotation of the extended driving unit responding to the extension operation signal, the draw guide portion may be moved vertically to extend and contract the multi-step portion.

A decoration unit may be detachably coupled to a front surface of the hands-free main body.

A coupling unit may be detachably coupled to a rear surface of the hands-free main body.

In accordance with another embodiment of the present invention, a hands-free device includes: upper and lower earphones; a hands-free main body having opened top and bottom surfaces; a control unit mounted in the hands-free main body and configured to apply an operation signal; and an earphone protruding unit formed in the hands-free main body and configured to protrude the upper earphone through a rear surface of the hands-free main body in response to a protrusion operation signal of the control unit; and an earphone drawing unit formed in the hands-free main body and configured to draw one or more of the upper and lower earphones through one or more of the top and bottom surfaces of the hands-free main body in response to a draw operation signal of the control unit.

The hands-free main body may include an earphone protrusion hole formed in the rear surface thereof, through which the upper earphone is protruded.

The earphone protruding unit may include: a protrusion guide portion formed horizontally inside the hands-free main body and having rails formed in a longitudinal direction thereof; a protrusion movement block having a bottom part coupled to the protrusion guide portion so as to linearly move and a top part coupled to an earphone boss portion; and a vertical driving unit formed at the bottom part of the protrusion movement block and configured to receive a protrusion operation signal of the control unit and apply a linear moving force to the protrusion movement block.

The top of the protrusion guide portion may be opened to form a housing space, the rails may be formed to extend horizontally while facing each other inward from both side surfaces, and the bottom part of the protrusion movement block may be housed in the housing space, and may have rail grooves formed in both side surfaces thereof, into which the rails are inserted to linearly move the protrusion movement block, while restricting the protrusion movement block from moving upward.

The protrusion guide portion may have a cut portion formed at a front end thereof, and the cut portion may be formed by removing the rail, and may release the upward movement restriction of the protrusion movement block.

The horizontal driving unit may include: a motor having a rotating shaft inserted horizontally inside the bottom of the protrusion movement block; a rotating rod having one end coupled to the motor shaft and the other end rotatably supported by the bottom inside of the protrusion movement block; a pinion gear having a central portion coupled to the rotating rod so as to transmit torque of the motor; and a horizontal rack bar formed on the bottom surface of the protrusion guide portion and engaged with the pinion gear so as to convert the rotation of the motor into a linear movement.

The pinion gear may have gear teeth formed to protrude downward from the bottom of the protrusion movement block.

The earphone drawing unit may be arranged or coupled in a vertical direction of the earphone protruding unit.

The earphone drawing unit may include: upper and lower draw guide portions formed in a vertical direction inside a front central portion of the hands-free main body and having rails formed in a longitudinal direction thereof; a draw movement block including a side extended portion coupled to the upper or lower draw guide portion so as to linearly move and a body portion coupled vertically to the side extended portion and detachably coupled to an upper or lower earphone boss portion; and a vertical driving unit formed at an end of the side extended portion and configured to receive the draw operation signal of the control unit and apply a linear moving force to the draw movement block.

The top of the upper or lower draw guide portion may be opened to form a housing space, the rails may be formed to extend vertically while facing each other inward from both side surfaces, and the side extended portion may be housed in the housing space, and may have rail grooves formed in both side surfaces thereof, into which the rails are inserted to linearly move the side extended portion while restricting the side extended portion from moving backward.

The upper draw guide portion may have a cut portion formed at the bottom thereof, and the cut portion may be formed by removing the rail, and may release the backward movement restriction of the side extended portion.

The bottom part of the protrusion movement block and the side extended portion of the draw movement block may be vertically formed, and the top part of the protrusion movement block and the body portion of the draw movement block may be integrated with each other.

The lower earphone boss portion may include a mike installed to receive an external voice signal.

The vertical driving unit may include: a motor having a rotating shaft inserted horizontally inside an end of the side extended portion; a rotating rod having one end coupled to the motor shaft and the other end rotatably supported by the end inside of the side extended portion; a pinion gear having a central portion coupled to the rotating rod so as to transmit torque of the motor; and a vertical rack bar formed on the bottom surface of the upper or lower draw guide portion and engaged with the pinion gear so as to convert the rotation of the motor into a linear movement.

The pinion gear may have gear teeth formed to protrude from the end of the side extended portion.

The earphone drawing unit may further include a telescopic unit formed in the lower draw guide portion and configured to extend and contract the lower draw guide portion in a vertical direction in response to an extension operation signal of the control unit.

The telescopic unit may include: a multi-step portion having the lowermost part fixed to the hands-free main body, formed along the circumference surface of the lower draw guide portion, and coupled to slide in a vertical direction; a rack bar having a bent portion formed of a bendable material, wherein one side of the rack bar based on the bent portion is coupled to move in a vertical direction along the inner surface of the hands-free main body and the other side of the rack bar is fixed and coupled to the bottom inside of the lower draw guide portion; and an extended driving unit engaged with the bent portion of the rack bar so as to provide a driving force. When the rack bar is moved vertically in connection with the rotation of the extended driving unit responding to the extension operation signal, the lower draw guide portion may be moved vertically in connection with the movement of the rack bar, thereby extending and contracting the multi-step portion.

The control unit may apply the draw operation signal to the earphone drawing unit to draw the lower earphone in response to a user's select instruction.

The control unit may apply the protrusion operation signal to the earphone protruding unit to protrude the upper earphone, and may apply the draw operation signal to the earphone protruding unit to draw the lower earphone, in response to a user's select instruction.

The control unit may apply the draw operation signal to the earphone drawing unit to draw the upper and lower earphones in response to a user's select instruction.

The control unit may apply the draw operation signal to the earphone drawing unit to draw the lower earphone, may apply the extension operation signal to the telescopic unit to extend the lower draw guide portion, and may apply the draw operation signal to the earphone drawing unit to draw the upper earphone.

A decoration unit may be detachably coupled to a front surface of the hands-free main body.

A coupling unit may be detachably coupled to the rear surface of the hands-free main body.

In accordance with another embodiment of the present invention, a hands-free device includes: an earphone; a hands-free main body having an opened bottom surface; a control unit mounted in the hands-free main body and configured to apply an operation signal; an earphone protruding unit formed in the hands-free main body and configured to protrude the earphone through a rear surface of the hands-free main body in response to a protrusion operation signal of the control unit; and an earphone drawing unit formed in the hands-free main body and configured to draw the earphone through the bottom surface of the hands-free main body in response to a draw operation signal of the control unit.

The hands-free main body may have an earphone protrusion hole formed in the rear surface thereof, through which the earphone is protruded.

The earphone protruding unit may include: a protrusion guide portion formed horizontally inside the top part of the hands-free main body and having rails formed in a longitudinal direction thereof; a protrusion movement block having a top part coupled to the protrusion guide portion to linearly move and a bottom part coupled to an earphone boss portion; and a vertical driving unit formed at the top part of the protrusion movement block and configured to receive the protrusion operation of the control unit and apply a linear moving force to the protrusion movement block.

The top of the protrusion guide portion may be opened to form a housing space, the rails may be formed to extend horizontally while facing each other inward from both side surfaces, and the top part of the protrusion movement block may be housed in the housing space, and may have rail grooves formed in both side surfaces thereof, into which the rails are inserted to linearly move the protrusion movement block while restricting the protrusion movement block from moving downward.

The protrusion guide portion may have a cut portion formed at a front end thereof, and the cut portion may be formed by removing the rail and may release the downward movement restriction of the protrusion movement block.

The horizontal driving unit may include: a motor having a rotating shaft inserted horizontally inside the top of the protrusion movement block; a rotating rod having one end coupled to the motor shaft and the other end rotatably supported by the top inside of the protrusion movement block; a pinion gear having a central portion coupled to the rotating rod so as to transmit torque of the motor; and a horizontal rack bar formed on the inner bottom surface of the protrusion guide portion and engaged with the pinion gear so as to convert the rotation of the motor into a linear movement.

The pinion gear may have gear teeth formed to protrude upward from the top of the protrusion movement block.

The earphone drawing unit may be disposed or coupled vertically to the bottom of the earphone protruding unit.

The earphone drawing unit may include: a draw guide portion formed in a vertical direction inside a front side of the hands-free main body, and having rails formed in a longitudinal direction thereof; a draw movement block having a side extended portion coupled to the draw guide portion so as to linearly move and a body portion detachably coupled to an earphone boss portion; and a vertical driving unit formed at an end of the side extended portion and configured to receive the draw operation signal of the control unit and apply a linear moving force to the draw movement block.

The top of the draw guide portion may be opened to form a housing space, the rails may be formed to extend while facing each other inward from both side surfaces, and the side extended portion may be housed in the housing space, and may have rail grooves formed in both side surfaces thereof, into which the rails are inserted to linearly move the side extended portion while restricting the side extended portion from moving backward.

The draw guide portion may have a cut portion formed therein, and the cut portion may be formed by removing the rail, and may release the backward movement restriction of the side extended portion.

The top part of the protrusion movement block and the side extended portion of the draw movement block may be vertically formed, and the bottom part of the protrusion movement block and the body portion of the draw movement block may be integrated with each other.

The earphone boss portion may include a mike installed to receive an external voice signal.

The vertical driving unit may include: a motor having a rotating shaft inserted horizontally inside an end of the side extended portion; a rotating rod having one end coupled to the motor shaft and the other end rotatably supported by the end inside of the side extended portion; a pinion gear having a central portion coupled to the rotating rod so as to transmit torque of the motor; and a vertical rack bar formed on the inner bottom surface of the draw guide portion and engaged with the pinion gear so as to convert the rotation of the motor into a linear movement.

The pinion gear may have gear teeth formed to protrude from the end of the side extended portion.

The earphone drawing unit may further include a telescopic unit formed in the draw guide portion and configured to extend and contract the draw guide portion in a vertical direction in response to an extension operation signal of the control unit.

The telescopic unit may include: a multi-step portion having the lowermost part fixed to the hands-free main body, formed along the circumferential surface of the draw guide portion, and coupled to slide in a vertical direction; a rack bar having a bent portion formed of a bendable material, wherein one side of the rack bar based on the bent portion is coupled to move vertically along the inner surface of the hands-free main body, and the other side of the rack bar is fixed and coupled to the bottom inside of the draw guide portion; and an extended driving unit engaged with the bent portion of the rack bar so as to provide a driving force. When the rack bar is moved vertically in connection with the rotation of the extended driving unit responding to the extension operation signal, the draw guide portion may be moved vertically in connection with the movement of the rack bar, thereby extending and contracting the multi-step portion.

The control unit may apply the protrusion operation signal to the earphone protruding unit to protrude the earphone in response to a user's select instruction.

The control unit may apply the draw operation signal to the earphone drawing unit to draw the earphone in response to a user's select instruction.

The control unit may apply the draw operation signal to the earphone drawing unit to draw the earphone, and may apply the extension operation signal to the telescopic unit to extend the draw guide portion, in response to a user's select instruction.

A decoration unit may be detachably coupled to a front surface of the hands-free main body.

A coupling unit may be detachably coupled to the rear surface of the hands-free main body.

In accordance with the embodiments of the present invention, the earphone serving as an output unit in the hands-free device may be moved in various manners by a user's simple manipulation so as to be easily placed on the user's ear. Accordingly, since the user may select and use a desired type, the convenience of the hands-free device may be maximized.

Furthermore, the earphone may be contracted and moved into the hands-free main body so as to be stored in the hands-free main body, and the cable is wound inside the hands-free main body so as not to be seen from outside, thereby maximizing the convenience. Accordingly, the miniaturization and portability of the hands-free device may be secured, and the wound cable may be extended and used when needed. Therefore, the hands-free device may be worn at various positions of a user's body or clothes. In particular, the mike is included in the earphone, and the cable of the earphone is extended and used. Therefore, the portability and the convenience may be provided.

The hands-free device may be coupled to a detachable decoration unit or coupling unit so as to be utilized as an accessory worn on the user's hair or clothes. Therefore, the hands-free device may be modified into various types of accessories according to the user's taste or clothes and the circumstances. The utilization of the hands-free device may be maximized.

Furthermore, since the hands-free device includes the coupling unit, the earphone drawing unit, the extendable cable, the telescopic unit and the like, the hands-free device may be worn at a desired position such as a user's body or clothes, and may be immediately used if needed. Therefore, the hands-free device does not need to be separately stored.

Meanwhile, the hands-free device includes the mike which is included in the earphone and extended by the telescopic unit, and the above-described coupling unit is mounted on the hands-free main body. Therefore, the utilization range may be further extended.

Furthermore, since the miniaturized hands-free device may be integrated with various electronic devices, the utilization of the hands-free device may be maximized.

That is, the control unit and the earphones of the hands-free device may be configured as individual modules. Accordingly, control modules of various electronic devices and various types of earphone phones may be combined. Therefore, the user may obtain a desired combination, and the combination may be easily changed.

DESCRIPTION OF SPECIFIC EMBODIMENTS

Figure 1:
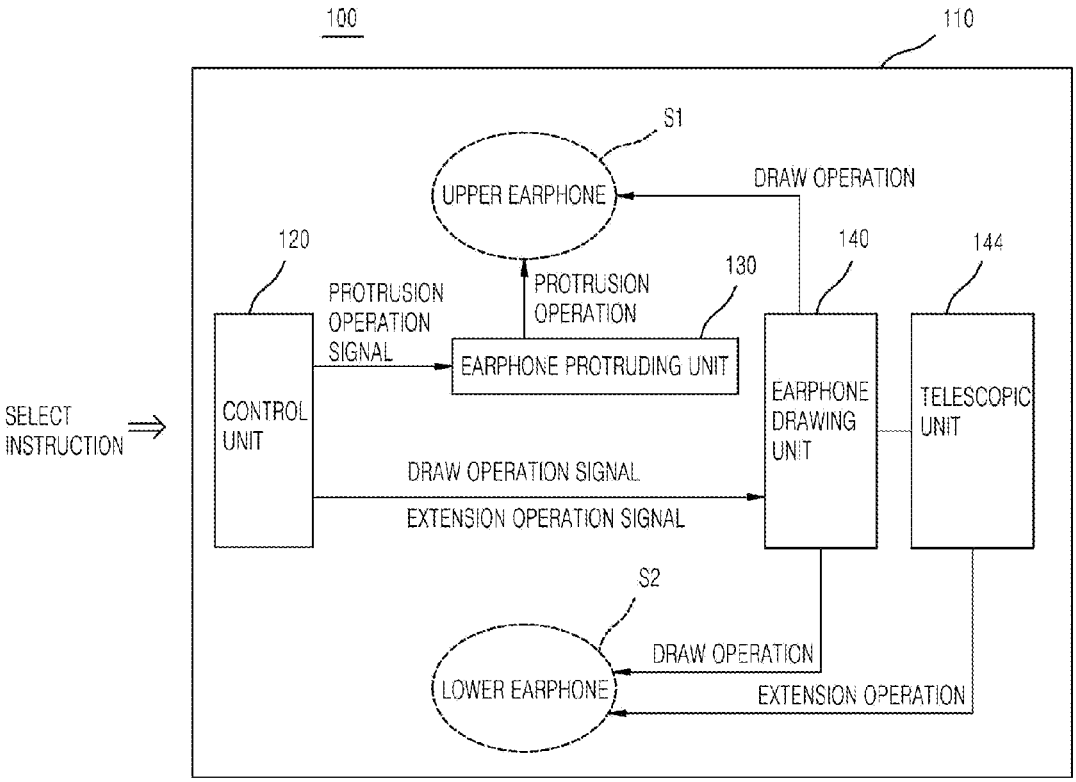
FIG. 1 is a block diagram conceptually illustrating the configuration of a hands-free device in accordance with a first embodiment of the present invention.

Exemplary embodiments of the present invention will be described below in more detail with reference to the accompanying drawings.

The present invention may, however, be embodied in different forms and should not be constructed as limited to the embodiments set forth herein.

Rather, these embodiments are provided so that this disclosure will be thorough and complete, and will fully convey the scope of the present invention to those skilled in the art.

Throughout the disclosure, like reference numerals refer to like parts throughout the various figures and embodiments of the present invention.

First Embodiment

FIG. 1 is a block diagram conceptually illustrating the configuration of a hands-free device in accordance with an embodiment of the present invention.

Referring to FIG. 1, the hands-free device 100 in accordance with the embodiment of the present invention includes a hands-free main body 110, a control unit 120, an earphone protruding unit 130, and an earphone drawing unit 140.

The hands-free device 100 in accordance with the embodiment of the present invention includes an upper earphone S1 and a lower earphone S2 as an output unit. Here, the terms "upper" and "lower" are used to distinguish the earphones from each other for convenience of description, and do not limit the positions of the earphones. The upper and lower earphones indicate a stereo output unit which is inserted into user's ears or placed adjacent to the user's ears.

First, the hands-free main body 110 will be described.

The hands-free main body 110 basically serves as a housing including the control unit 120, the earphone protruding unit 130, the earphone drawing unit 140, and the upper and lower earphones S1 and S2.

Figure 2:
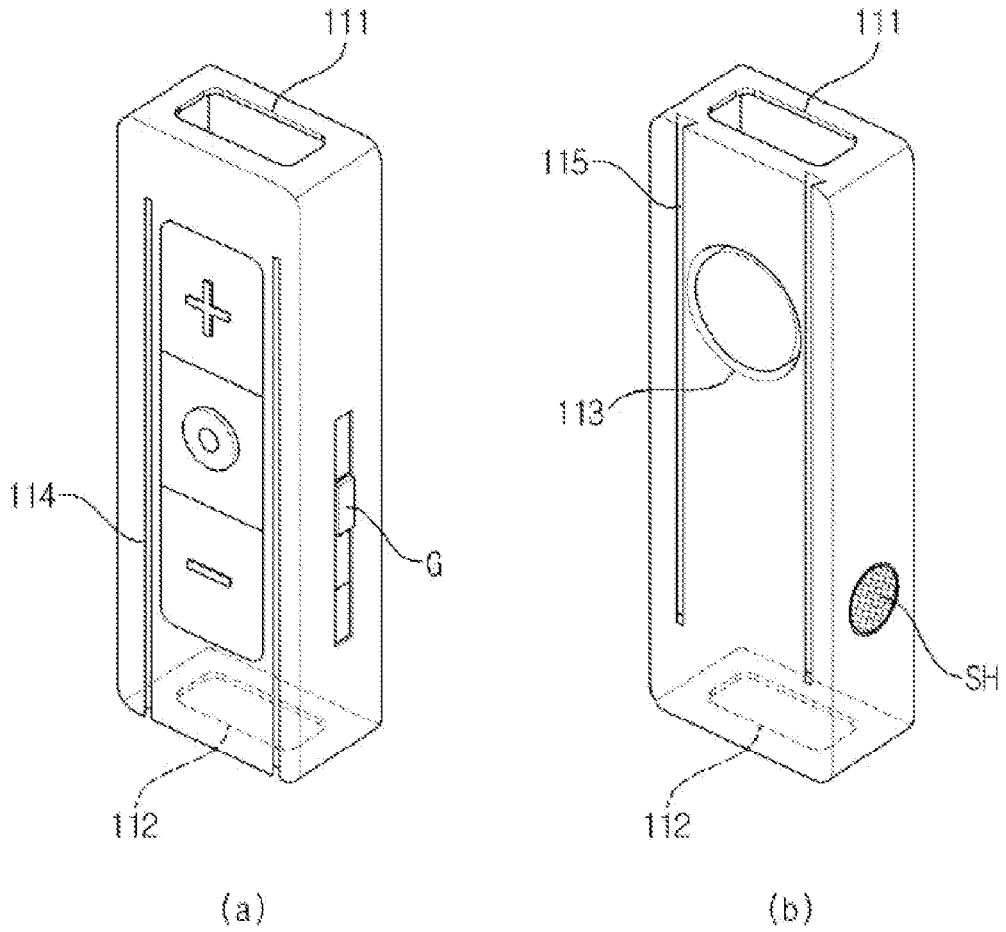
FIGS. 2A and 2B are schematic front and rear views of a hands-free main body which is conceptually illustrated in FIG. 1.

FIG. 2A is a schematic front view of the hands-free main body 110, and FIG. 2B is a schematic rear view of the hands-free main body 110.

Referring to FIGS. 2A and 2B, the hands-free main body 110 has a rectangular block-shaped exterior, and includes an empty housing space formed therein. However, the present invention is not limited to the exterior of the hands-free main body 110, but may be embodied in various shapes without departing from the scope of implementing the functions of the hands-free device.

The hands-free main body 110 has opened top and bottom surfaces 111 and 112. Referring to FIG. 2B, the hands-free main body 110 has an earphone protrusion hole 113 formed in the rear surface thereof.

The opened top and bottom surfaces 111 and 112 serve as paths through which the upper and lower earphones S1 and S2 are drawn from inside the hands-free device 110 by the earphone drawing unit 140 which will be described below. The opened top and bottom surfaces 111 and 112 may be formed to have a predetermined opening area such that the upper and lower earphones S1 and S2, an earphone boss portion (refer to B of FIG. 3) to support the upper and lower earphones S1 and S2, a protrusion movement block (refer to 132 of FIG. 3), and a draw movement block (refer to 142 of FIG. 3) pass through the opened top and bottom surfaces 111 and 112.

Referring to FIG. 2A, the hands-free main body 110 may have a mode determination unit G formed in a side surface thereof. The mode determination unit G is configured to receive a select instruction through a user's direct/indirect manipulation, in order to instruct the control unit 120 to apply a protrusion operation signal, a draw operation signal, and an extension operation signal.

Referring to FIG. 2A, the mode determination unit G includes switch buttons to instruct the control unit 120 to apply corresponding signals. However, the present invention is not limited thereto, but may be implemented in various manners, for example, in a touch type, a voice recognition type and the like.

The mode determination unit G determines one of four operation states (fixed mode, protrusion mode, cable extension mode, and sliding extension mode) according to a user's direct manipulation, and applies an operation signal corresponding to the determined operate state to the control unit 120.

Meanwhile, the hands-free main body 110 has manipulation buttons such as +/− arranged on the front surface thereof and connected to the control unit 120. The sizes and shapes of the manipulation buttons may be set in such a manner that a user may manipulate the manipulation buttons without seeing with eyes.

Furthermore, although not illustrated, the hands-free main body 110 may have openings in which ports for transmitting and receiving data and power to and from other electronic devices are provided.

Furthermore, the hands-free main body 110 may have a pair of grooves 114 formed on the front surface thereof and elongated in a vertical direction. The grooves 114 are formed to couple to a decoration unit (refer to P of FIG. 19) which will be described below. More specifically, one ends of the grooves 114 may be connected to the bottom of the hands-free main body 110 such that the decoration unit is inserted into the grooves 114 from the bottom of the hands-free main body 110, and the other ends of the grooves 114 may not be connected to the top of the hands-free main body 110 such that the inserted decoration unit does not come off through the top of the hands-free main body 110.

The hands-free main body 110 may have another pair of grooves 115 formed on the rear surface thereof and elongated in a vertical direction. The grooves 115 are formed to couple to a coupling unit (refer to 200 of FIG. 17) which will be described below. More specifically, one ends of the grooves 115 may be connected to the top of the hands-free main body 110 such that the coupling unit is inserted into the grooves 115 from the top of the hands-free main body 110, and the other ends of the grooves 115 may not be connected to the bottom of the hands-free main body 110 such that the inserted coupling unit does not come off through the bottom of the hands-free main body 110.

The present invention is not limited to the structure of the grooves 114 and 115, and the grooves 114 and 115 may have various structures for coupling the decoration unit and the coupling unit to the hands-free main body 110.

Meanwhile, referring to FIG. 2B, the hands-free main body 110 may have a speaker SH mounted on a side surface thereof, the speaker SH serving as a separate output unit.

Next, the control unit 120 will be described.

The control unit 120 is mounted in the above-described hands-free main body 110 and serves to apply the operation signals including a protrusion operation signal, a draw operation signal, and an extension operation signal.

The protrusion operation signal refers to a control signal to advance or retreat the protrusion movement block 132 toward and from the rear surface of the hands-free main body 110 such that the upper earphone S1 is protruded from or inserted into the earphone protrusion hole 113.

The draw operation signal refers to a control signal to advance or retreat the draw movement block 142 toward or from one or more of the top and bottom surface 111 and 112 of the hands-free main body 110 such that one or more of the upper and lower earphones S1 and S2 is drawn from or inserted into one or more of the opened top and bottom surface 111 and 112.

The extension operation signal refers to a control signal to extend or contract a lower draw guide portion 141*b* through the opened bottom surface 112 of the hands-free main body 110. The lower draw guide portion 141*b* is formed in a multistage form and will be described below.

The control unit 120 includes electronic elements mounted on a predetermined printed circuit board (PCB) or the like and serves to process data. The control unit 120 includes a motor control driver to control the positions, speeds, and torques of motors 133*a* and 143*a* of a horizontal driving unit 133 and a vertical driving unit 144 which will be described below.

The motor control driver controls the positions, speeds, and torques of the motors 133*a* and 143*a* in an open loop manner according to a manipulation on the above-described decision unit G.

That is, the control unit 120 controls the motors 133*a* and 143*a* in an open loop manner using the mode determination unit G as a manipulation unit, based on the operation signals including the protrusion operation signal, the draw operation signal, and the extension operation signal.

In the hands-free device 100 in accordance with the embodiment of the present invention, the control unit 120 may additionally include a communication module or a music file play module such as MP3 which is connected to an input/output unit and a data processing unit. In this case, the hands-free device 100 may be utilized as a portable electronic device for multipurpose.

Next, the earphone protrusion unit 130 will be described.

Figure 3:
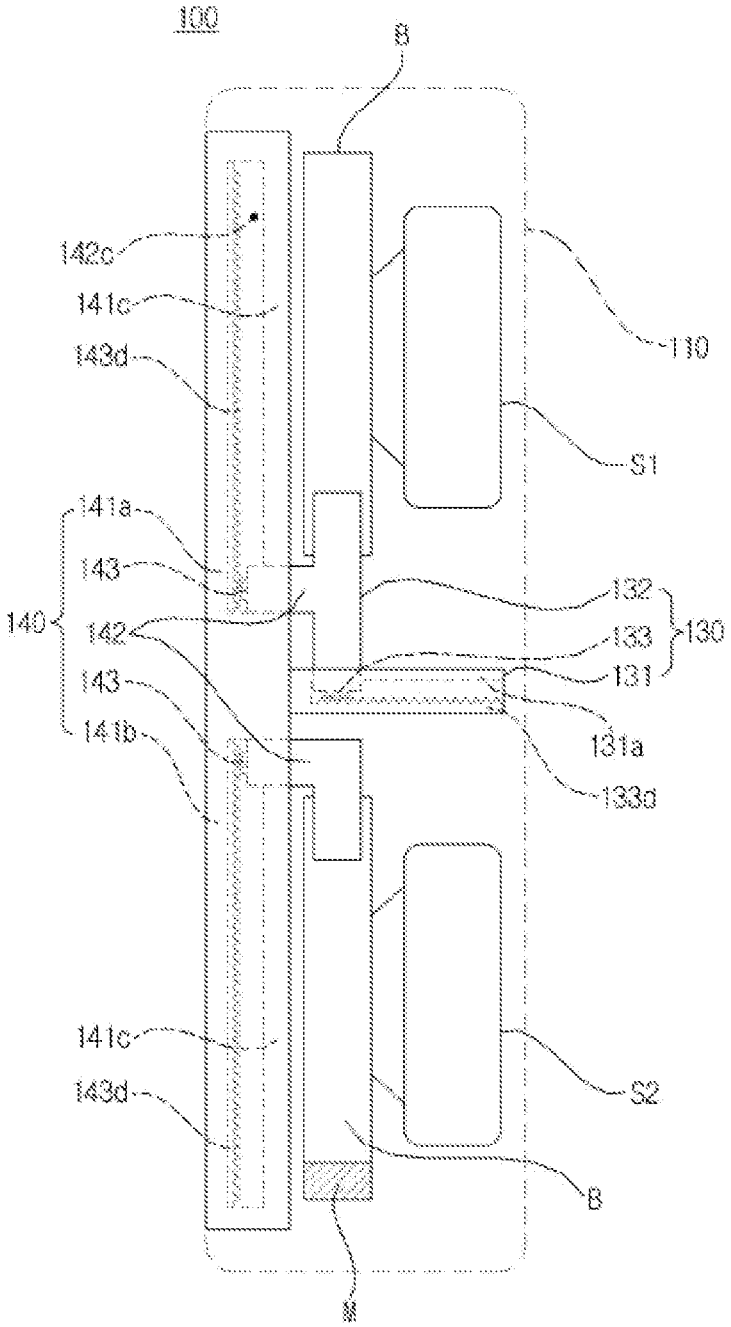
FIG. 3 is a schematic view for explaining the specific structures of an earphone protruding unit and an earphone drawing unit which are conceptually illustrated in FIG. 1.

FIG. 3 is a schematic view illustrating the specific structures of the earphone protruding unit and the earphone drawing unit which are conceptually illustrated in FIG. 1. FIGS. 4A and 4B are plan and cross-sectional views illustrating the structure of the protrusion guide portion illustrated in FIG. 3. FIGS. 5A and 5B are front and side views illustrating the structures of the protrusion movement block, the horizontal driving unit, the draw movement block, and the vertical driving unit.

FIG. 3 illustrates only specific portions in order to conceptually clarify the structure of the embodiment of the present invention. Accordingly, the drawing may be modified in various manners, and the present invention is not limited to the drawing.

The earphone protruding unit 130 serves to protrude the upper earphone S1 through the earphone protrusion hole 113 formed on the rear surface of the above-described hands-free main body 110 in response to the protrusion operation signal of the above-described control unit 120.

Referring to FIG. 3, the earphone protruding unit 130 includes the protrusion guide portion 131, the protrusion movement block 132, and the horizontal driving unit 133.

The protrusion guide portion 131 is horizontally formed in the internal central portion of the hands-free main body 110, and has rails 131*a* formed in a longitudinal direction thereof.

As illustrated in FIG. 4A, the protrusion guide portion 131 is formed in a rectangular block shape. Furthermore, as illustrated in FIG. 4B, the top of the protrusion guide portion 131 is opened to form a housing space, and the rails 131*a* are formed to extend horizontally while facing each other inward from both side surfaces.

Furthermore, a horizontal rack bar 133*d* to be described below is mounted on the inner bottom surface of the housing space of the protrusion guide portion 131.

Meanwhile, the protrusion guide portion 131 has a cut portion 131 formed at a front end thereof (left direction of FIG. 3 and upward direction of FIG. 4A). The cut portion 131 is formed by removing the rail 131*a*.

The cut portion 131*c* is formed to move the protrusion movement block 132 upward. More specifically, when the protrusion movement block 132 is moved toward the front side of the hands-free main body 110 (left direction of FIG. 3) and positioned at the front end of the protrusion guide portion 131, the protrusion movement block 132 which has been restricted from moving upward by the rails 131*a* may be moved upward through the cut portion 131*c*.

Therefore, the cut portion 131*c* may have a size corresponding to the size of the protrusion movement block 132 that the protrusion movement block 132 is drawn upward.

The protrusion guide portion 131 may have one end coupled vertically to upper and lower draw guide portions 141*a* and 141*b* which will be described below, or may be extended from one body.

The protrusion movement block 132 is a member to linearly move along the protrusion guide portion 131, and detachably coupled to the earphone boss portion B.

Referring to FIGS. 5A and 5B, the protrusion movement block 132 is formed in a rectangular block shape, the top of the protrusion movement block 132 is detachably coupled to the earphone boss portion B, and the horizontal driving unit 133 is formed at the bottom of the protrusion movement block 132.

The protrusion movement block 132 and the draw movement block 142 to be described below are distinguished from each other depending on the shapes and functional characteristics thereof, but may be extended from one block or coupled to each other.

The top of the protrusion movement block 132 is coupled to the earphone boss portion B.

The bottom of the protrusion movement block 132 is housed in the housing space of the protrusion guide portion 131, and has rail grooves 132 formed in the side surfaces thereof, into which the rails 131*a* are inserted. As the rails 131*a* are coupled to the rail grooves 132, the protrusion movement block 132 may be moved linearly in the horizontal direction along the protrusion guide portion 131.

At the bottom of the protrusion movement block 132, the horizontal driving unit 133 is provided.

The horizontal driving unit 133 serves to apply a driving force to linearly move the protrusion movement block 132, and includes a motor 133*a*, a rotating rod 133*b*, a pinion gear 133*c*, and a horizontal rack bar 133*d*.

Figure 5:
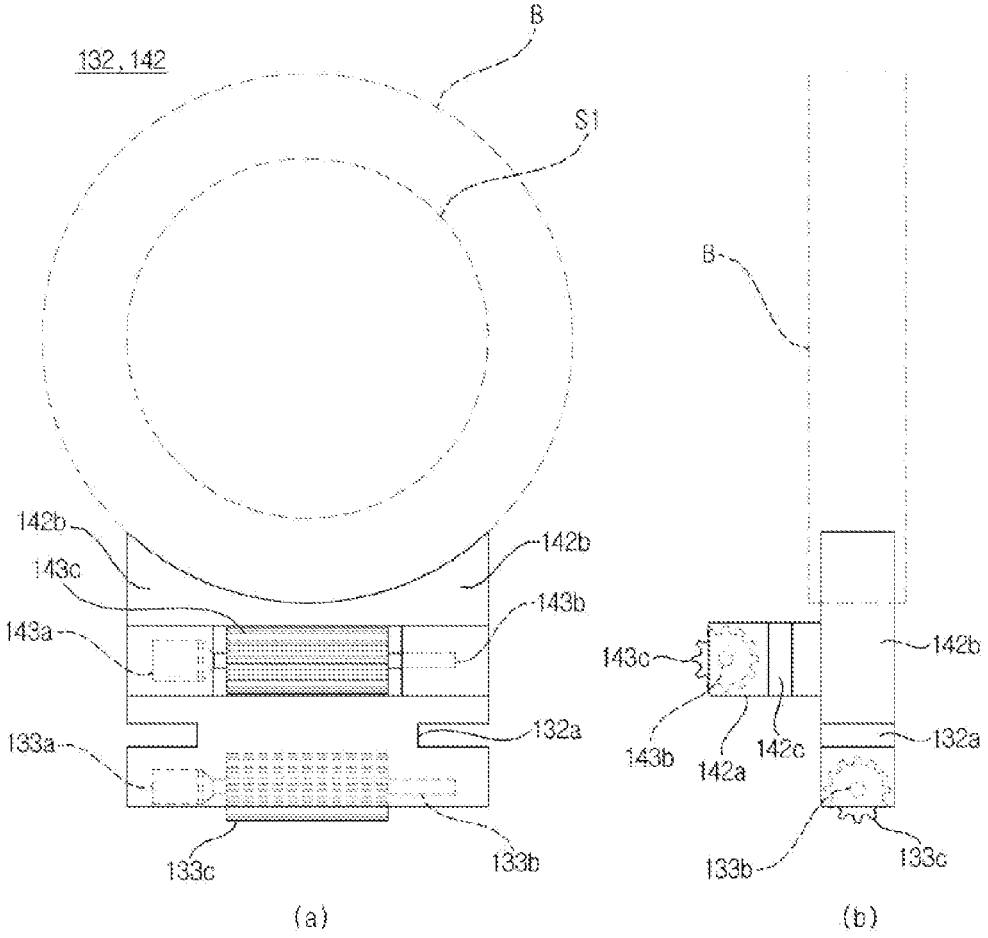
FIGS. 5A and 5B are front and side views for explaining the structures of a protrusion movement block, a horizontal driving unit, a draw movement block, and a vertical driving unit which are illustrated in FIG. 3.

As illustrated in FIG. 5, the motor 133*a* has a rotating shaft inserted horizontally inside the bottom of the protrusion movement block 132. The motor 133*a* serves to provide torque. In this embodiment of the present invention, an ultra-small motor having a thickness of 4 mm or less may be used.

The rotating rod 133*b* has one end coupled to the shaft of the motor 133*a* and the other end rotatably supported by the bottom inside of the protrusion movement block 132, and serves to transmit the torque of the motor 133*a*. At this time, the protrusion movement block 132 has an insertion groove formed in the bottom inside thereof, into which the rotating rod 133*b* is rotatably inserted and supported.

The pinion gear 133*c* has a central portion coupled to the rotating rod 133*b* so as to transmit the driving force of the motor 133*a*.

At this time, the arrangement positions of the motor 133*a* and the rotating rod 133*b* or the size of the pinion gear 133*c* may be decided in such a manner that the gear teeth of the pinion gear 133*c* protrude downward from the bottom of the protrusion movement block 132.

This structure may prevent the bottom of the protrusion movement block 132 from interfering with engagement between the pinion gear 133*c* and the horizontal rack bar 133*d*.

In order to effectively transmit the torque, the pinion gear 133*c* may be formed to be elongated in the longitudinal direction of the rotating rod 133*b*.

The horizontal rack bar 133*d* has gear teeth formed on the top surface thereof, which are to be engaged with the gear teeth of the pinion gear 133*c*, and serves to convert the rotation of the motor 133*a* into a linear movement.

Figure 4:
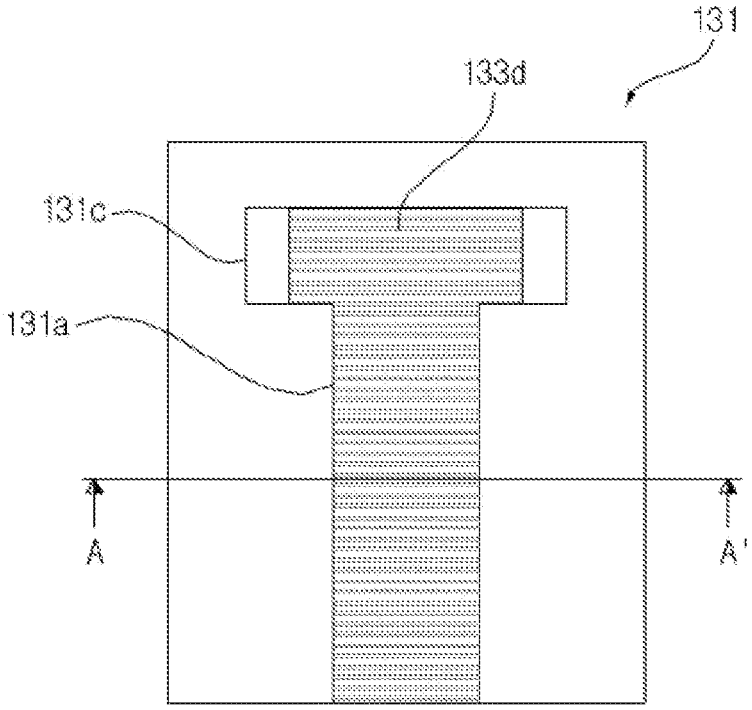
FIGS. 4A and 4B are plan and cross-sectional views for explaining the structure of a protrusion guide portion of FIG. 3.
Figure 4:
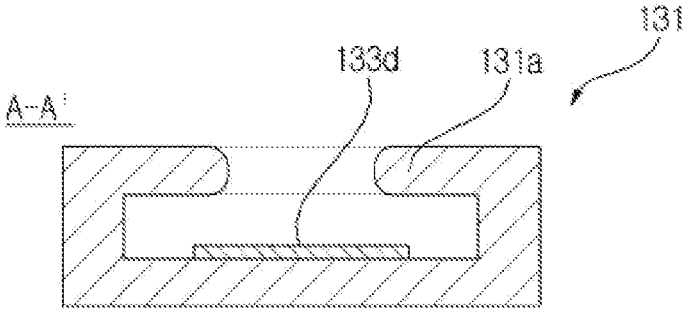

As illustrated in FIG. 4, the horizontal rack bar 133*d* has a predetermined width and is elongated in the longitudinal direction of the protrusion guide portion 131. The horizontal rack bar 133*d* is coupled to the inner bottom surface of the protrusion guide portion 131.

The horizontal rack bar 133*d* may have a width larger than that of the pinion gear 133*c* such that the pinion gear 133*c* is engaged with the horizontal rack bar 133*d* with a sufficient margin.

The horizontal rack bar 133*d* is engaged with the pinion gear 133*c* so as to linearly move the protrusion movement block 132 along the protrusion guide portion 131 in connection with the rotation of the motor 133*a*.

The horizontal driving unit 133 having the above-described structure serves to advance or retreat the protrusion movement block 132 toward or from the rear surface of the hands-free main body 110 in response to the protrusion operation signal of the above-described control unit 120.

According to the protrusion operation signal, the protrusion movement block 132 is advanced toward the rear surface of the hands-free main body 110 so as to expand and protrude the upper earphone S1. When the protrusion movement block 132 is retreated, the upper earphone S1 is first contracted and the protrusion movement block 132 is then retreated from the rear surface of the hands-free main body 110 such that the upper earphone S1 is housed in the hands-free main body 110. According to the above-described structure, the volume of the earphone may be minimized to increase the portability, and the earphone may be easily converted into such a form to be easily put into a user's ear, when the earphone is used.

Next, the earphone drawing unit 140 will be described.

Figure 6:
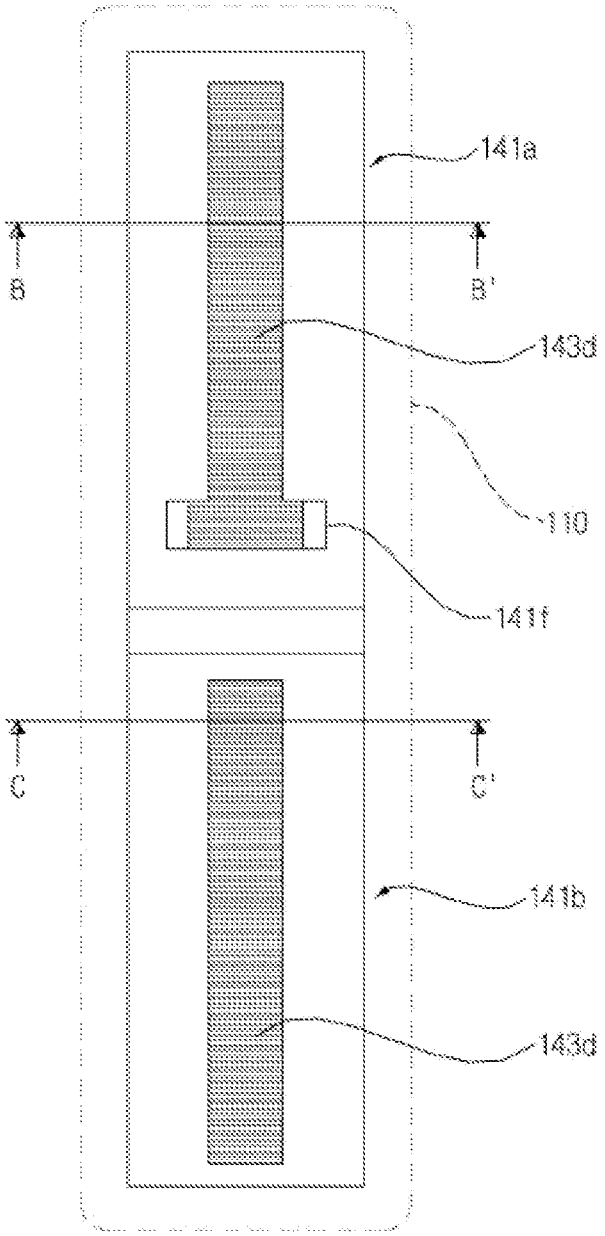
FIG. 6 is a plan view for explaining the structures of upper and lower draw guide portions.
Figure 7:
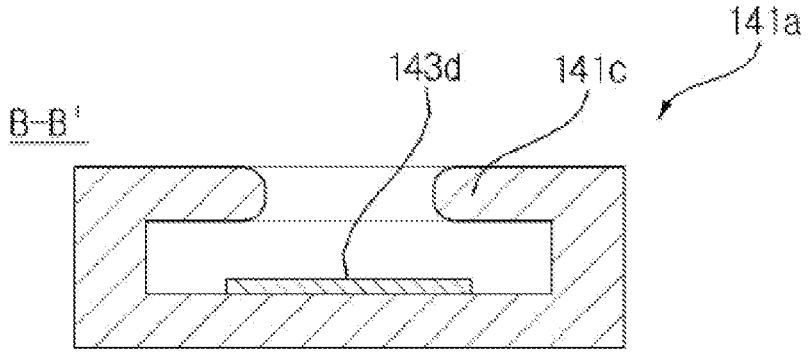
FIG. 7 is a cross-sectional view taken along line B-B' of FIG. 6.

FIG. 6 is a plan view illustrating the structures of the upper and lower draw guide portions 141*a* and 141*b* illustrated in FIG. 3. FIG. 7 is a cross-sectional view taken along line B-B' of FIG. 6.

The earphone drawing unit 140 serves to draw the upper and lower earphones S1 and S2 through the opened top and bottom surfaces 111 and 112 of the above-described hands-free main body 110, respectively, in response to the draw operation signal of the control unit 120.

As illustrated in FIG. 3, the earphone drawing unit 140 includes the upper draw guide portion 141*a*, the lower draw guide portion 141*b*, the draw movement block 142, and the vertical driving unit 143.

The upper and lower draw guide portions 141*a* and 141*b* are formed vertically in the internal central portion of the hands-free main body 110, and have rails 141*c* formed in the longitudinal direction thereof.

As illustrated in FIG. 6, the upper and lower draw guide portions 141*a* and 141*b* are formed in a rectangular block shape. As illustrated in FIG. 7, the top of the upper and lower draw guide portions 141*a* and 141*b* is opened to form a housing space, and the rails 141*c* are formed to extend horizontally while facing each other toward the inside from both side surfaces.

Furthermore, a vertical rack bar 143*d* to be described below is mounted on the inner bottom surfaces of the housing spaces of the upper and lower draw guide portions 141*a* and 141*b*.

Meanwhile, the upper draw guide portion 141*a* has a cut portion 141*f* formed at the bottom thereof (corresponding to the center of FIGS. 3 and 6). The cut portion 141*f* is formed by removing the rail 141*c*.

The cut portion 141*f* is formed to move the draw movement block 142 backward. More specifically, when the draw movement block 142 to be described below is moved toward the center of the hands-free main body 110 (corresponding to the center of FIG. 3) and positioned at the bottom of the upper draw guide portion 141*a*, the draw movement block 142 which has been restricted from moving backward (right direction of FIG. 3) by the rails 141*c* is moved backward through the cut portion 141*f*.

Therefore, the cut portion 141*f* may be formed to have a size corresponding to the size of the draw movement block 142 such that the draw movement block 142 is drawn backward.

Meanwhile, the draw movement block 142 is a member to linearly move along the upper and lower draw guide portions 141*a* and 141*b*, and detachably coupled to the earphone boss portion B.

Specifically, the draw movement block 142 includes a side extension portion 142*a* and a body portion 142*b*. The side extension portion 142*a* is coupled to the upper and lower draw guide portions 141*a* and 141*b* so as to move linearly. The body portion 142*b* is detachably coupled to the upper earphone boss portion B or lower earphone boss portion B.

As illustrated in FIG. 3, the draw movement block 142 coupled to the upper earphone boss portion B is formed to be connected to the above-described protrusion movement block 132 as one block. The body portion 142*b* of the draw movement block 142 is functionally distinguished from the protrusion movement block 132, for convenience of description. However, the body portion 142*b* and the protrusion movement block 132 are formed as one block so as to be coupled to the upper earphone boss portion B.

The draw movement block 142 coupled to the lower earphone boss portion B is formed in an L-shape and divided into the side extension portion 142*a* formed in a horizontal direction and the body portion 142*b* formed in a vertical direction.

The body portion 142*b* is coupled to the upper and lower earphone bosses B around which a cable to transmit signals to the earphones S1 and S2 is wounded and stored.

Although described below, a user may detach and pull the earphone boss B from the draw movement block 142 so as to extend the cable. Accordingly, the wearing range of the earphones S1 and S2 may be expanded.

The side extension portion 142*a* of the draw movement block 142 has an end housed in the housing spaces of the upper and lower draw guide portions 141*a* and 141*b*. Furthermore, as illustrated in FIG. 5B, the side extension portion 142*a* has rail grooves 142*c* formed in side surfaces thereof, into which the rails 141*c* are inserted. As the rails 141*c* are coupled to the rail grooves 142*c*, the draw movement block 142 may be linearly moved in a vertical direction along the upper and lower draw guide portions 141*a* and 141*b*.

The vertical driving unit 143 is provided at the end of the side extension portion 142*a*.

The vertical driving unit 143 serves to apply a driving force to linearly move the draw movement block 142, and includes a motor 143*a*, a rotating rod 143*b*, a pinion gear 143*c*, and a vertical rack bar 143*d*.

The motor 143*a*, the rotating rod 143*b*, the pinion gear 143*c*, and the vertical rack bar 143*d* have the same characteristics and structures as those of the above-described vertical driving unit 133. The following descriptions will be focused on differences therebetween.

As illustrated in FIG. 5, the motor 143*a* has a rotating shaft inserted horizontally inside the end of the side extension portion 142*a* of the draw movement block 142. The rotating rod 143*b* has one end coupled to the shaft of the motor 143*a* and the other end rotatably supported by the end inside of the side extension portion 142*a*, and serves to transmit the torque of the motor 143*a*. At this time, the side extension portion 142*a* may have an insertion groove in the end inside thereof, into which the rotating rod 143*b* is rotatably inserted and supported.

Meanwhile, the arrangement positions of the motor 143*a* and the rotating rod 143*b* or the size of the pinion gear 143*c* may be decided in such a manner that the gear teeth of the pinion gear 143*c* protrude from the end of the side extension portion 142*a*.

This structure may prevent the end of the side extension portion 142*a* from interfering with engagement with the vertical rack bar 143*d* to be described below.

Referring to FIGS. 6 and 7, the vertical rack bar 143*d* has a predetermined width and is formed to be elongated in the longitudinal direction. The vertical rack bar 143*d* is coupled to the inner bottom surfaces of the upper and lower draw guide portions 141*a* and 141*b*.

The vertical driving unit 143 having the above-described structure serves to advance or retreat the draw movement block 142 toward or from one or more of the top and bottom surfaces 111 and 112 of the hands-free main body 110 in response to the draw operation signal of the above-described control unit 120.

Then, a telescopic unit 144 will be described as an additional embodiment of the above-described earphone drawing unit 140.

Figure 8:
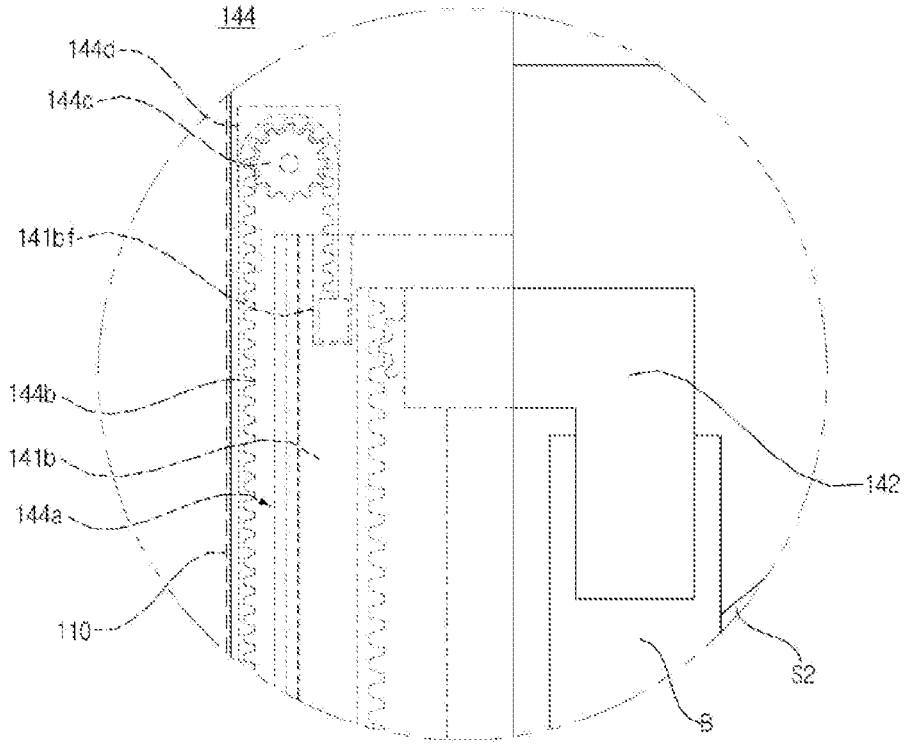
FIG. 8 is a schematic view for explaining the structure of a telescopic unit which is conceptually illustrated in FIG. 1.
Figure 9:
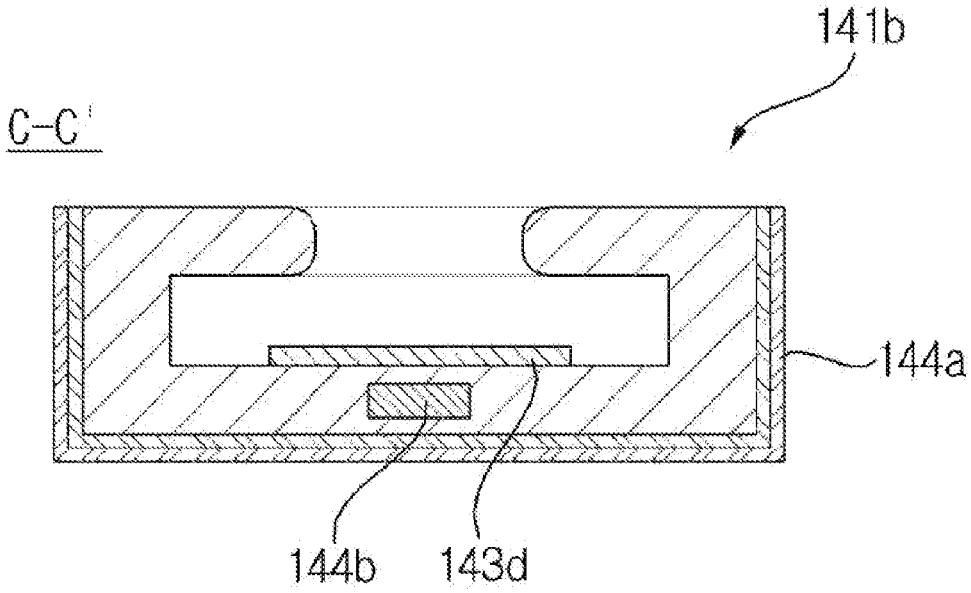
FIG. 9 is a cross-sectional view taken along line C-C' of FIG. 6.

FIG. 8 is a schematic view illustrating the structure of the telescopic unit which is conceptually illustrated in FIG. 1. FIG. 9 is a cross-sectional view taken along line C-C' of FIG. 6.

The telescopic unit 144 serves to extend and contract the lower draw guide portion 141*b* in a vertical direction in response to the extension operation signal of the above-described control unit 120.

Referring to FIG. 8, the telescopic unit 144 includes a multi-step portion 144*a*, a rack bar 144*b*, and an extended driving unit 144*c*.

As illustrated in FIGS. 8 and 9, the multi-step portion 144*a* has a structure in which members to slide in a vertical direction are stacked along the circumferential surface of the lower draw guide portion 141*b*, with the bottom surface of the lower draw guide portion 141*b* set to the uppermost part of the multi-step portion 144*a*. That is, the lowermost member of the multi-step portion 144*a* is fixed to the hands-free main body 110, and the uppermost member serves as the bottom surface of the lower draw guide portion 141*b*.

The rack bar 144*b* serves to extend and contract the multi-step portion 144*a* which is formed to slide in a vertical direction, when the lower draw guide portion 141*b* coupled to the multi-step portion 144*a* is pushed or pulled in a vertical direction.

The rack bar 144*b* is formed of a bendable material, and has gear teeth formed on the top surface thereof, which are to be engaged with the extended driving unit 144*c*.

The rack bar 144*b* has a bent portion formed therein. Based on the bent portion, one side of the rack bar 144*b* is coupled to move in a vertical direction along the inner surface of the hands-free main body 110, and the other side of the rack bar 144*b* is fixed to the bottom inside of the lower draw guide portion 141*b*.

The one side of the rack bar 144*b* may be formed to move in a vertical direction along the inner surface of the hands-free main body 110 by a separate guide member or rail or a guide housing member as represented by reference numeral 144*d* of FIG. 8.

The other side of the rack bar 144*b* is fixed to the bottom inside of the lower draw guide portion 141*b*. For this structure, the lower draw guide portion 141*b* has a rack bar housing portion 141*bf* formed on the top surface thereof such that the rack bar 144*b* may be housed and fixed in the rack bar housing portion 141*bf*.

As the other end of the rack bar 144*b* is inserted and fixed in the rack bar housing portion 141*bf*, the lower draw guide portion 141*b* is moved in connection with the movement of the rack bar 144*b*.

The extended driving unit 144*c* is disposed to be engaged with the rack bar 144*b* at the bent portion of the rack bar 144*b*. Although not illustrated, the extended driving unit 144*c* includes a motor and a gear assembly, and serves to apply torque to the rack bar 144*b*.

Accordingly, when the motor of the extended driving unit 144*c* is rotated in the clockwise direction in response to the extension operation signal of the control unit 120, the one side of the rack bar 144*b* is moved upward along the inner surface of the hands-free main body 110, and the other side of the rack bar 144*b* is moved downward while pushing the lower draw guide portion 141*b* downward.

As the lower draw guide portion 141*b* is moved downward, the multi-step portion 144*a* is extended, and the lower draw guide portion 141*b* is extended and drawn through the opened bottom surface 112 of the hands-free main body 110.

Then, when the motor of the extended driving unit 144*c* is rotated in the counterclockwise direction in response to the extension operation signal of the control unit 120, the one side of the rack bar 144*b* is moved downward along the inner surface of the hands-free main body 110, and the other side of the rack bar 144*b* is moved upward while pulling the lower draw guide portion 141*b* upward.

As the lower draw guide portion 141*b* is moved upward, the multi-step portion 144*a* is contracted, and the lower draw guide portion 141*b* is contracted and inserted through the opened bottom surface 112 of the hands-free main body 110.

Hereinafter, operation examples of the hands-free device in accordance with the embodiment of the present invention will be described with reference to FIGS. 10 to 13.

First, the fixed mode will be described.

FIGS. 10A to 10D are schematic views and a block diagram for explaining the fixed mode among the operation states of the hands-free device illustrated in FIG. 1.

The fixed mode refers to a mode in which the hands-free device in accordance with the embodiment of the present invention is placed on one ear of a user through an auxiliary unit such as an ear hook in a state where the upper earphone S1 is included in the hands-free main body 110, in order to use the upper earphone S1.

Figure 10:
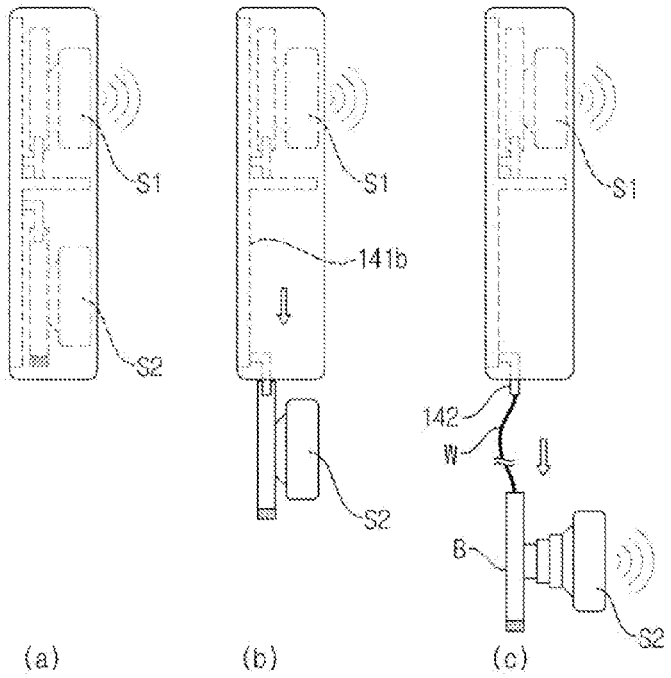
FIGS. 10A to 10D are schematic views and a block diagram for explaining a fixed mode among operation states of the hands-free device illustrated in FIG. 1.
Figure 10:
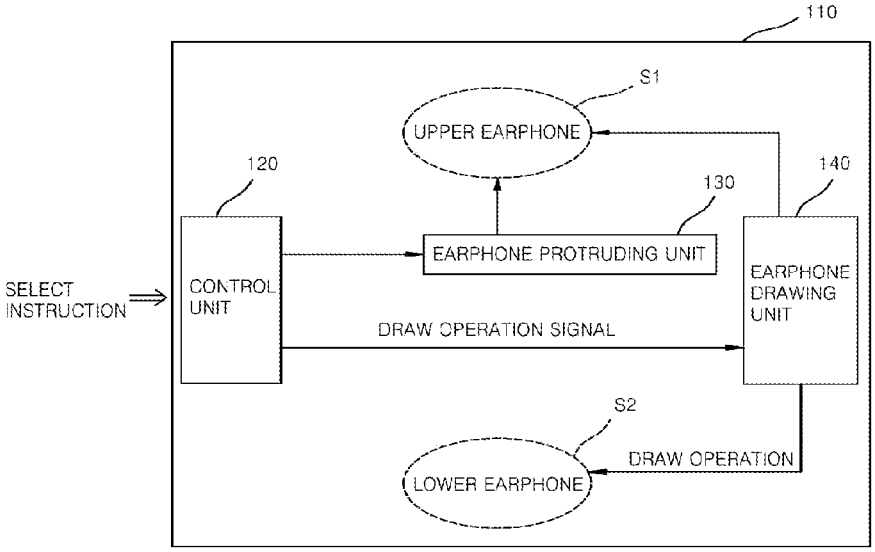

Then, according to a user's additional select instruction such as +/− button manipulation, the lower earphone S2 is drawn from the hands-free main body 110 so as to detach the lower earphone boss portion B from the draw movement block 142, as illustrated in FIG. 10. The cable W may be extended to place the lower earphone S2 on the other ear of the user.

At this time, referring to FIG. 10D, the control unit 120 applies the draw operation signal to the earphone drawing unit 140. Then, as illustrated in FIG. 10B, the lower earphone S2 is moved downward along the lower draw guide portion 141*b* and drawn through the bottom surface of the hands-free main body 110 by the earphone drawing unit 140.

Meanwhile, as illustrated in FIG. 10C, the lower earphone S2 may be expanded and protruded from the lower earphone boss portion B so as to be easily placed on the other ear of the user.

The structure in which the earphones S1 and S2 are expanded and protruded from the earphone boss portion B may be implemented through electrical and mechanical components connected to the control unit 120 in response to a user's external select instruction, or realized by a user's direct manipulation.

Next, the protrusion mode will be described.

FIGS. 11A to 11D are schematic views and a block diagram for explaining the protrusion mode among the operation states of the hands-free device illustrated in FIG. 1.

The protrusion mode refers to a mode in which the upper earphone S1 is moved in a horizontal direction and protruded from the earphone protrusion hole 113 of the hands-free main body 110 such that the hands-free device in accordance with the embodiment of the present invention is placed on one ear to use the upper earphone S1.

The protrusion mode corresponds to an operation state in which the earphone is directly placed on a user's ear without a placing unit such as an ear hook.

Figure 11:
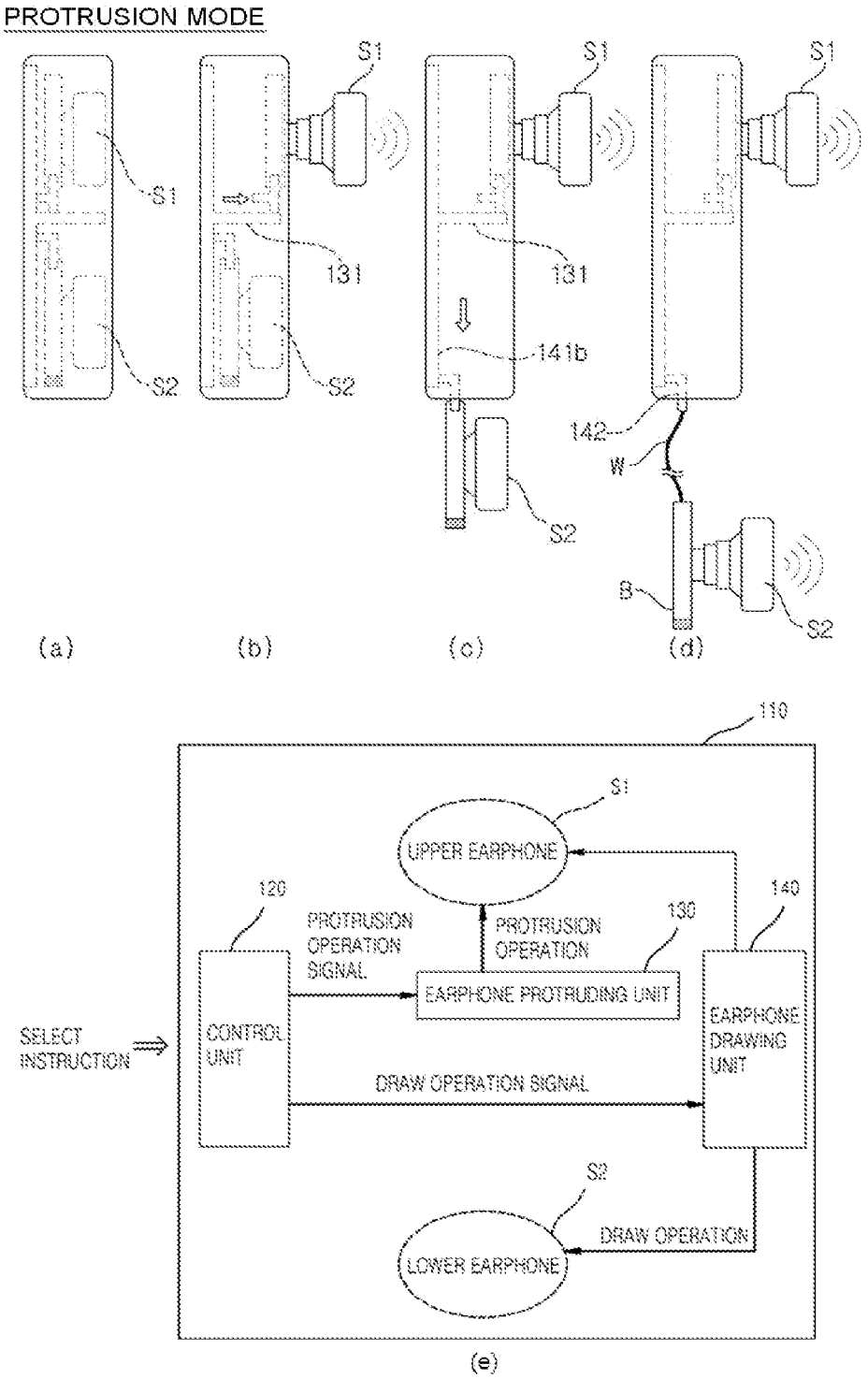
FIGS. 11A to 11E are schematic views and a block diagram for explaining a protrusion mode among the operation states of the hands-free device illustrated in FIG. 1.
Figure 12:
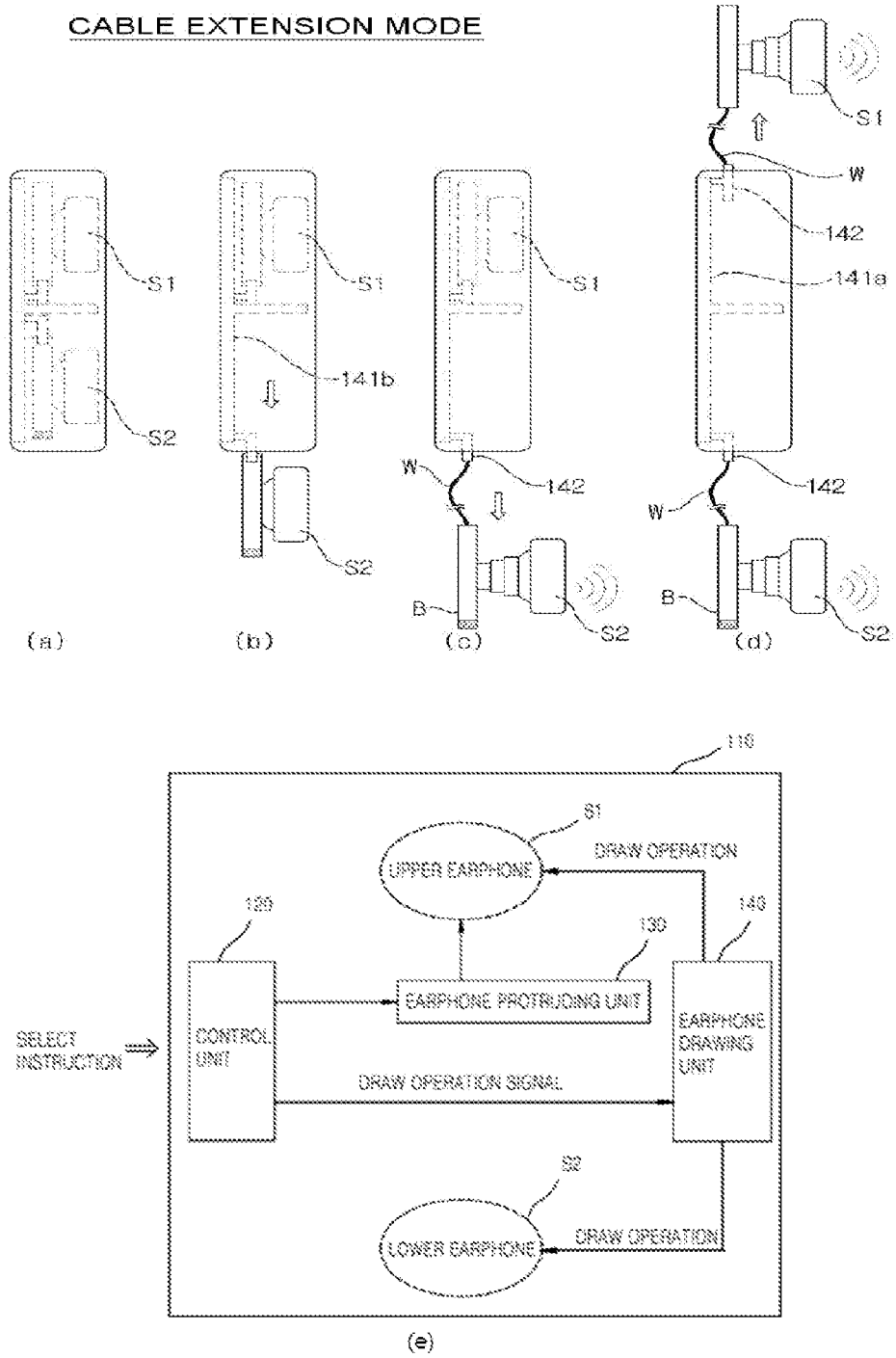
FIGS. 12A to 12E are schematic views and a block diagram for explaining a cable extension mode among the operation states of the hands-free device illustrated in FIG. 1.
Figure 13:
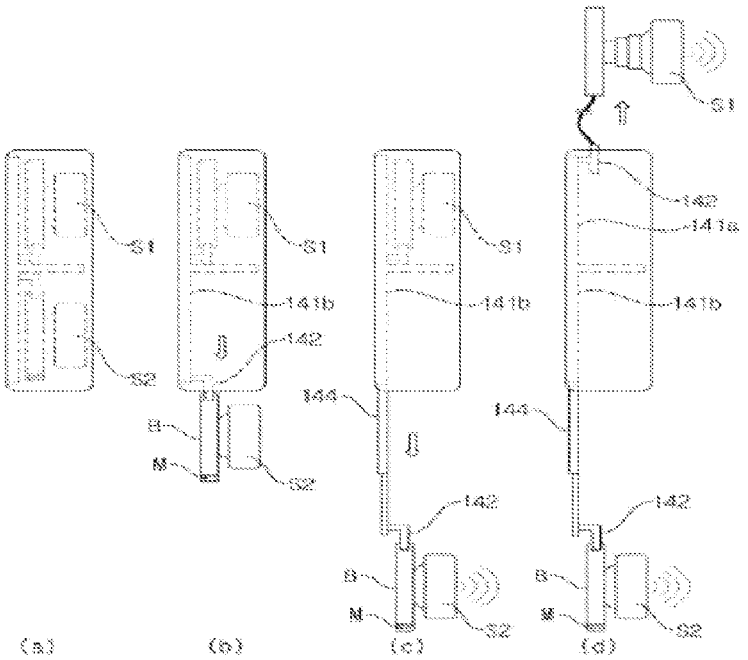
FIGS. 13A to 13E are schematic views and a block diagram for explaining a sliding extension mode among the operation states of the hands-free device illustrated in FIG. 1.
Figure 13:
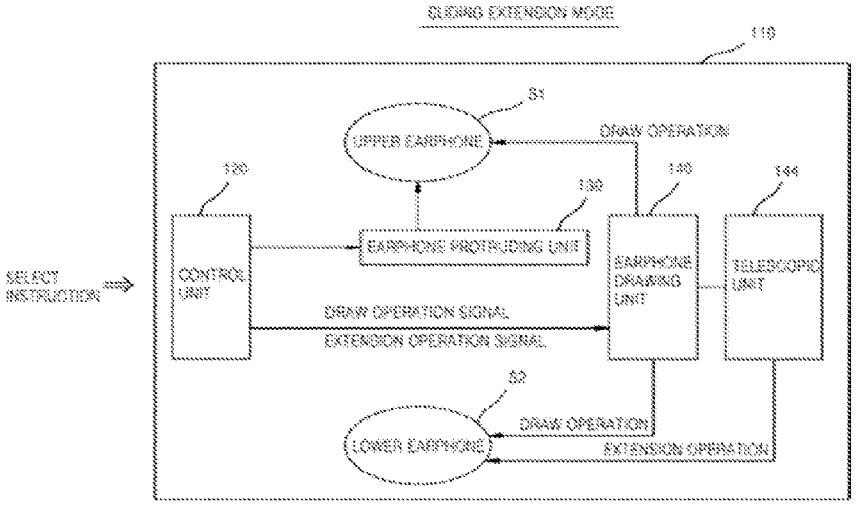

Then, according to a user's additional select instruction such as +/− button manipulation, the lower earphone S2 is drawn from the hands-free main body 110 so as to detach the lower earphone boss B from the draw movement block 142 as illustrated in FIG. 11, and the cable W is extended to place the lower earphone S2 on the other ear of the user.

At this time, referring to FIG. 11E, the control unit 120 applies the protrusion operation signal to the earphone protruding unit 130. Then, as illustrated in FIG. 11B, the upper earphone S1 is moved horizontally along the protrusion guide portion 131 and drawn through the earphone protrusion hole 113 of the hands-free main body 110 by the earphone protruding unit 130.

Furthermore, the control unit 120 applies the draw operation signal to the earphone drawing unit 140. Then, as illustrated in FIG. 11C, the lower earphone S2 is moved downward along the lower draw guide portion 141*b* and drawn through the bottom surface of the hands-free main body 110 by the earphone drawing unit 140.

Meanwhile, as illustrated in FIGS. 11B, 11C, and 11D, the upper earphone S1 may be expanded and protruded from the upper earphone boss portion B such that the upper earphone S1 is easily placed on the ear.

Next, the cable extension mode will be described.

FIGS. 12A to 12E are schematic views and a block diagram for explaining the cable extension mode among the operation states of the hands-free device illustrated in FIG. 1.

The cable extension mode refers to a mode in which the lower earphone S2 including a mike is moved downward to be drawn through the opened bottom surface 112 of the hands-free main body 110, and placed on one ear of a user.

As illustrated in FIGS. 12B and 12C, the lower earphone S2 is drawn from the hands-free main body 110 so as to detach the lower earphone boss portion B from the draw movement block 142, and the cable W is extended to place the lower earphone S2 on the one ear of the user. Since the lower earphone S2 includes the mike, the lower earphone S2 may be used even in a state where the hands-free device 100 is placed on various positions of the user's body.

According to a user's additional select instruction such as +/− button manipulation, the upper earphone S1 is drawn from the hands-free main body 110 so as to detach the upper earphone boss portion B from the draw movement block 142 as illustrated in FIG. 12D, and the cable W is extended to place the upper earphone S1 on the other ear of the user.

The cable extension mode is an operation mode which is useful when the hands-free device in accordance with the embodiment of the present invention is coupled to an accessory placed on user's clothes or a hair band so as to be utilized as an accessory. Regardless of whether the hands-free device is located on the user's clothes or hair, the upper and lower earphones S1 and S2 may be easily placed on the user's ears.

Referring to FIG. 12E, the control unit 120 applies the draw operation signal to the earphone drawing unit 140. Then, as illustrated in FIG. 12B, the lower earphone S2 is moved downward along the lower draw guide portion 141*b* and drawn through the bottom surface of the hands-free main body 110 by the earphone drawing unit 140.

Furthermore, according to an additional button manipulation or the like, the control unit 120 applies the draw operation signal to the earphone drawing unit 140. Then, as illustrated in FIG. 12D, the upper earphone S1 is moved upward along the upper draw guide portion 141*a* and drawn through the top surface of the hands-free main body 110 by the earphone drawing unit 140.

Meanwhile, as illustrated in FIGS. 12C and 12D, the upper and lower earphones S1 and S2 may be expanded and protruded from the upper and lower earphone boss portions B so as to be easily placed on the user's ears.

Next, the sliding extension mode will be described.

FIGS. 13A to 13E are schematic views and a block diagram for explaining the sliding extension mode among the operation states of the hands-free device illustrated in FIG. 1.

The sliding extension mode refers to a mode in which the lower earphone S2 is moved downward and the lower draw guide portion 141*b* is extended to move the mike M located at the lower earphone boss portion B downward together with the lower earphone S2.

The sliding extension mode is an operation mode for moving the lower earphone S2 connected to the mike M to one earhole of the user, when the hands-free device in accordance with the embodiment of the present invention is coupled to a hair band or worn in the form of a hairpin.

As illustrated in FIGS. 13B and 13C, the lower earphone S2 is drawn from the hands-free main body 110 and the lower draw guide portion 141*b* is extended from the multi-step portion 144*a* so as to move the lower earphone S2 connected to the mike M downward.

Then, according to a user's additional instruction such as +/− button manipulation, the upper earphone S1 is drawn from the hands-free main body 110 so as to detach the upper earphone boss portion B from the draw movement block 142 as illustrated in FIG. 13D, and the cable W is extended to place the upper earphone S1 on the other ear of the user.

Referring to FIG. 13E, the control unit 120 applies the draw operation signal to the earphone drawing unit 140. Then, as illustrated in FIG. 13B, the lower earphone S2 is moved downward along the lower draw guide portion 141*b* and drawn through the top surface of the hands-free main body 110 by the earphone drawing unit 140.

Furthermore, the control unit 120 applies the extension operation signal to the telescopic unit 144. Then, as illustrated in FIG. 13C, the lower draw guide portion 141*b* is extended by the telescopic unit 144.

Referring to FIG. 13E, the control unit 120 applies the draw operation signal to the earphone drawing unit 140 according to an additional button manipulation or the like. Then, as illustrated in FIG. 13D, the upper earphone S1 is moved upward along the upper drawing guide portion 141*a* and drawn through the top surface of the hands-free main body 110 by the earphone drawing unit 140.

Meanwhile, as illustrated in FIG. 13D, the upper earphone S1 may be expanded and protruded from the upper earphone boss portion B so as to be easily placed on the user's ear.

Hereafter, a hands-free device in accordance with another embodiment of the present invention will be described.

Second Embodiment

Figure 14:
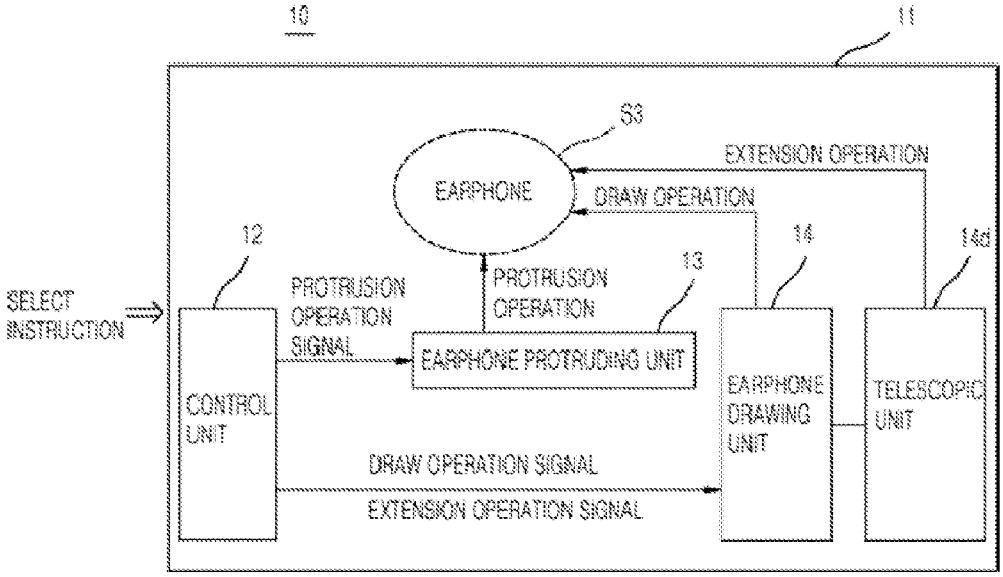
FIG. 14 is a block diagram conceptually illustrating the configuration of a hands-free device in accordance with a second embodiment of the present invention.
Figure 15:
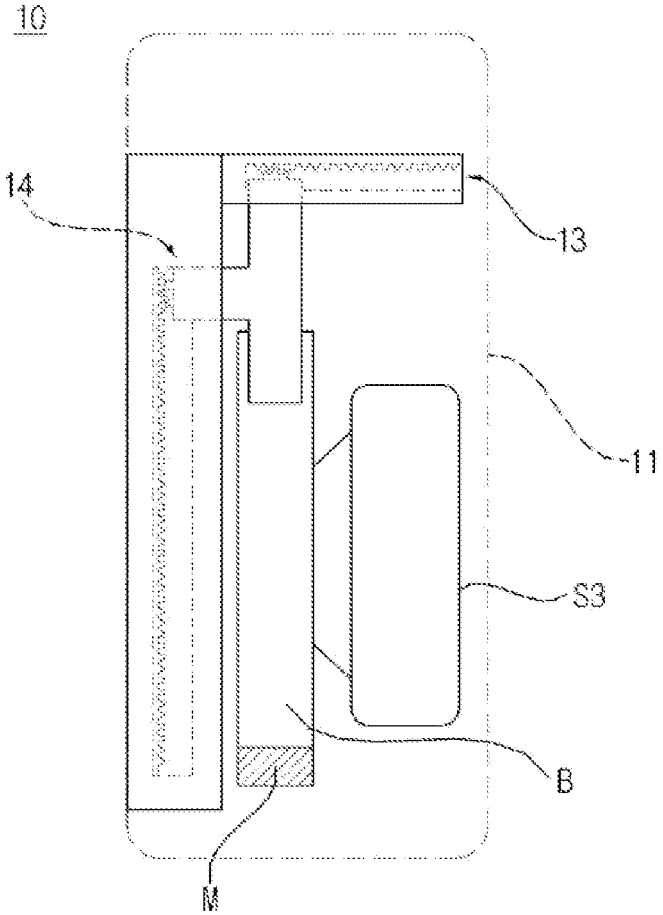
FIG. 15 is a schematic view for explaining the structures of an earphone protruding unit and an earphone drawing unit which are conceptually illustrated in FIG. 14.
Figure 16:
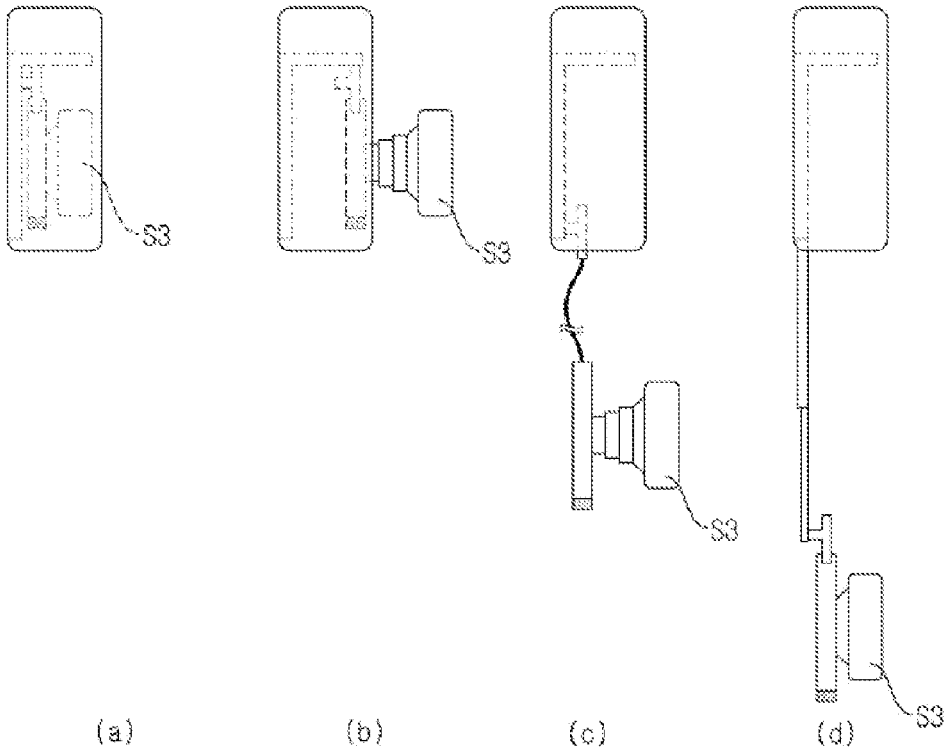
FIG. 16 is a schematic view for explaining an operation state of the hands-free device of FIG. 14.

FIG. 14 is a block diagram conceptually illustrating the configuration of a hands-free device in accordance with a second embodiment of the present invention. FIG. 15 is a schematic view of an earphone protruding unit and an earphone drawing unit which are conceptually illustrated in FIG. 14. FIG. 16 is a schematic view for explaining an operation state of the hands-free device of FIG. 14.

The hands-free device 10 in accordance with the embodiment of the present invention has a single earphone S3 as an output unit.

Referring to FIGS. 14 and 15, the hands-free device 10 in accordance with the embodiment of the present invention includes a hands-free main body 11, a control unit 12, an earphone protruding unit 13, an earphone drawing unit 13, and a telescopic unit 14*d*.

The hands-free device 10 in accordance with the embodiment of the present invention includes the earphone protruding unit 13, the earphone drawing unit 14, and the telescopic unit 13*d* to manipulate the single earphone S3. The structures and characteristics of the components of the hands-free device 10 in accordance with the embodiment of the present invention are the same as those of the above-described first embodiment. Therefore, the detailed descriptions thereof are omitted herein.

The operation mode of the single earphone S3 includes a fixed mode illustrated in FIG. 16A, a protrusion mode illustrated in FIG. 16B, a cable extension mode illustrated in FIG. 16C, and a sliding extension mode illustrated in FIG. 16D. Since the operation modes are the same as those of the above-described first embodiment, the detailed descriptions thereof are omitted herein.

Hereinafter, examples in which the hands-free device in accordance with the embodiment of the present invention is used for multipurpose will be described with reference to the accompanying drawings.

Figure 17:
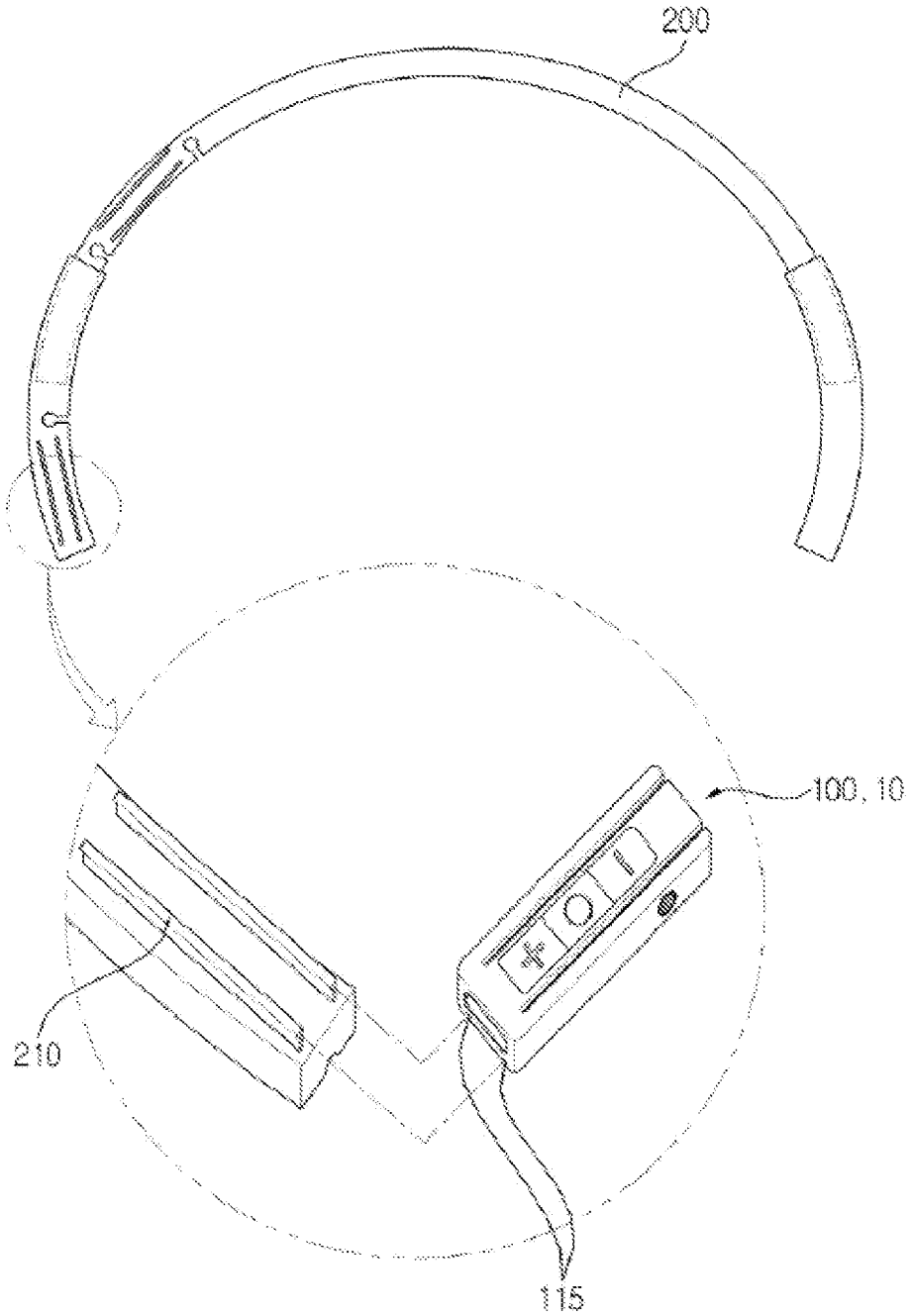
FIG. 17 is a conceptual view illustrating a state in which the hands-free device of FIG. 1 or 14 is coupled to a hair band-type coupling unit.
Figure 18:
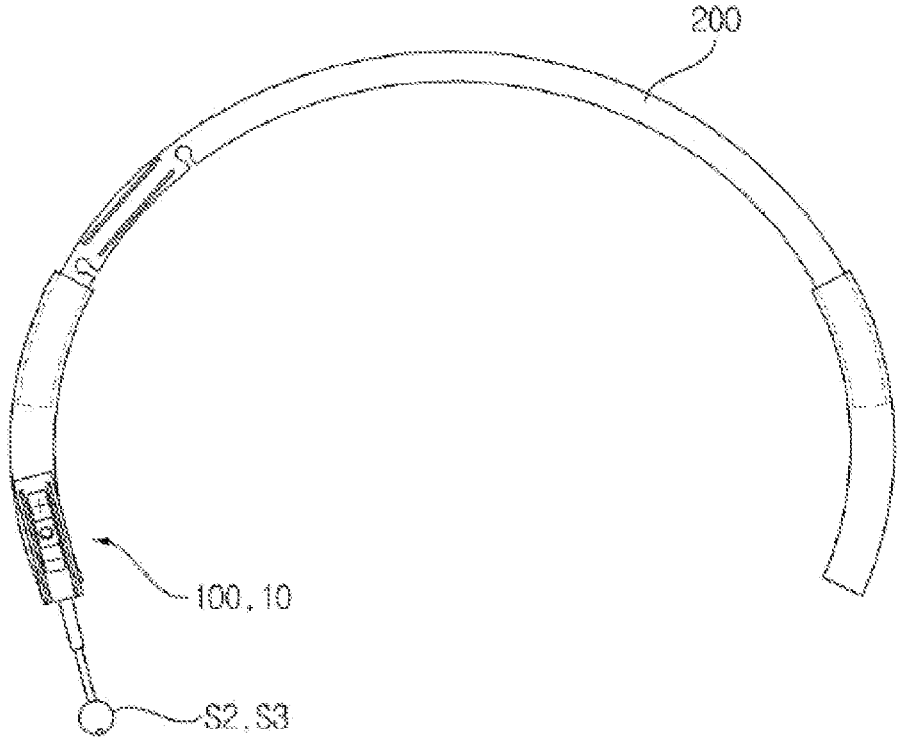
FIG. 18 is a conceptual view illustrating a state in which the hands-free device of FIG. 1 or 14 is coupled to a hair band-type coupling unit and extended by the telescopic unit
Figure 19:
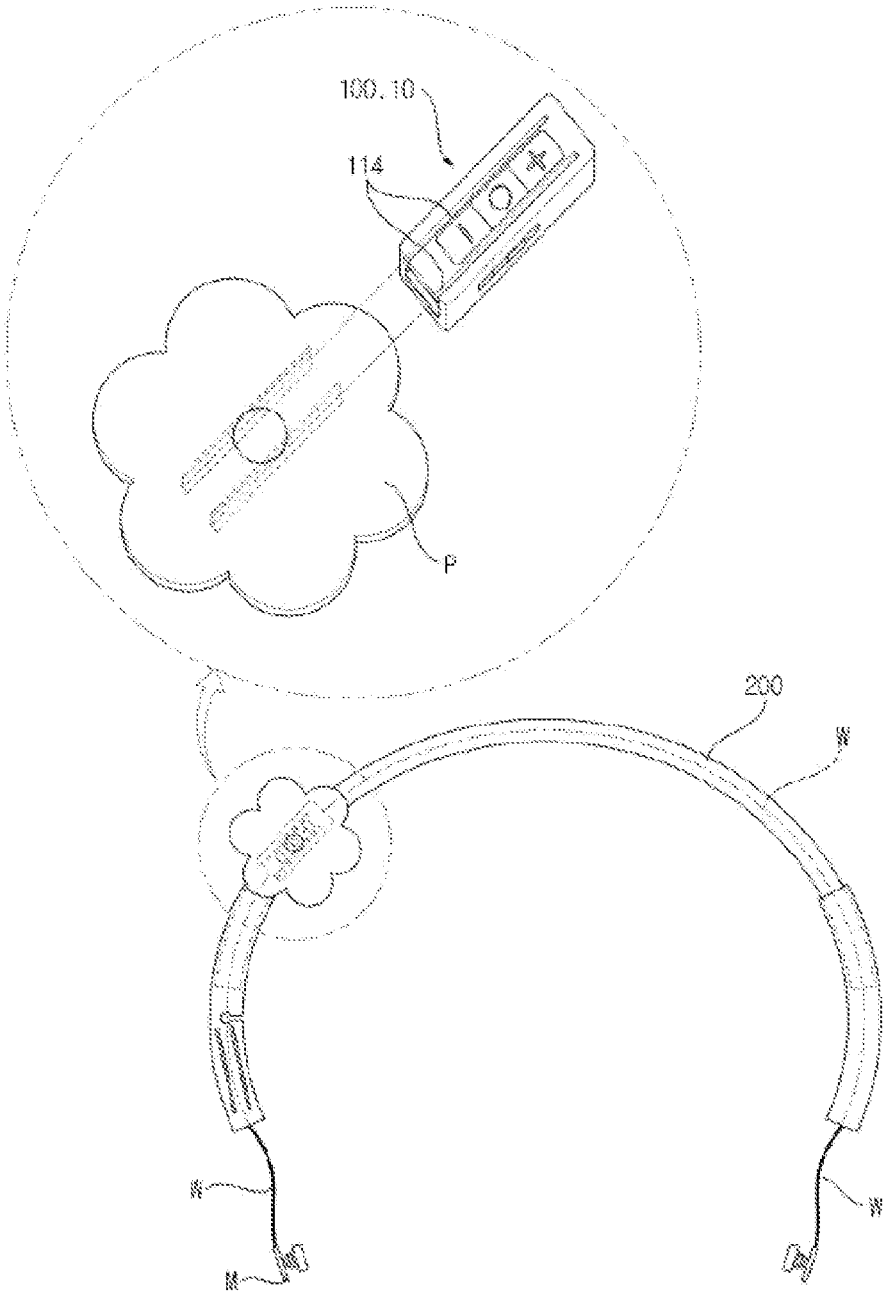
FIG. 19 is a conceptual view illustrating a state in which the hands-free device of FIG. 1 or 14 is coupled to a hair band-type coupling unit, a cable of an earphone is extended so as to be placed in the hair band-type coupling unit in the cable extension mode, and a decoration unit is mounted.

FIG. 17 is a conceptual view illustrating a state in which the hands-free device of FIG. 1 or 14 is coupled to a hair band-type coupling unit. FIG. 18 is a conceptual view illustrating a state in which the hands-free device of FIG. 1 or 14 is coupled to a hair band-type coupling unit and extended by the telescopic unit. FIG. 19 is a conceptual view illustrating a state in which the hands-free device of FIG. 1 or 14 is coupled to a hair band-type coupling unit, the cable of the earphone is extended so as to be placed in the hair band-type coupling unit in the cable extension mode, and a decoration unit is mounted.

As illustrated in FIG. 17, the hands-free device 100 or 10 in accordance with the embodiment of the present invention may be coupled to a hair band-type coupling unit 200.

The hair band-type coupling unit 200 may include a plurality of attachment/detachment rails 210. The attachment/detachment rails 210 formed in the hair band-type coupling unit 200 are inserted into the grooves 115 formed on the rear surface of the hands-free main body 110 or 11 such that the hair band-type coupling unit 200 and the hands-free main body 100 or 10 are coupled to each other.

However, the coupling relationship is only an example, and the present invention is not limited thereto.

The hair band-type coupling unit 200 illustrated in FIGS. 17, 18, and 19 is only an example of a coupling unit through which the hands-free device 100 or 10 may be worn at various positions such as a user's body and clothes. The user may selectively couple various coupling units such as hairpin, clothespin, and clip to the hands-free device 100 or 10.

As illustrated in FIG. 18, the hands-free device 100 or 10 is coupled to the hair band-type coupling unit 200, and the earphone S2 or S3 connected to the mike M is moved downward by the telescopic unit so as to be placed on one ear of the user.

Meanwhile, as illustrated in FIG. 19, the decoration unit P is inserted into the grooves 114 formed on the front surface of the hands-free main body 110 or 11 such that the decoration unit P and the hands-free main body 110 or 11 are coupled to each other.

However, the above-described coupling relationship is only an example, and the present invention is not limited thereto.

The buttons arranged on the front surface of the hands-free main body 110 or 11 may be manipulated through the decoration unit P even in a state where the decoration unit P is coupled to the hands-free main body 110 or 11. As illustrated in FIG. 19, the decoration unit P and the hands-free main body 110 or 11 may be integrated with each other such that the buttons are elastically pressed and manipulated through the decoration unit P. Alternatively, individual decoration buttons may be added to correspond to the respective buttons arranged on the front surface of the hands-free main body 110 or 11, or the buttons of the hands-free main body 110 or 11 may be replaced with decoration buttons.

FIG. 19 illustrates the flower-shaped decoration unit P. However, this is only an example, and the present invention is not limited thereto. That is, the decoration unit P may be modified into various types of decoration units P such that a user may selectively attach and detach the decoration units P according to the user's taste or clothes.

When the hair band-type coupling unit 200 and the hands-free device 100 or 10 in accordance with the embodiment of the present invention are coupled and used, the cable W may be extended and used, if necessary. At this time, the extended cable W may be placed inside the hair band-type coupling unit 200 so as not to be seen from outside. For this structure, the cable W may be inserted into holes formed in the hair band-type coupling unit 200 and placed along rail grooves formed on the inner surface of the hair band-type coupling unit 200 such that the earphones are located at both ends of the coupling unit 200. The positions and number of the holes may differ depending on the positions and number of the attachment/detachment rails 210 formed on the front surface of the hair band-type coupling unit 200.

As various types of coupling units and decoration units P are detachably coupled to the hands-free device 110 or 11, the hands-free device in accordance with the embodiment of the present invention may be utilized as a modifiable accessory as well as an electronic device.

The hands-free device in accordance with the embodiment of the present invention is not only applied to a general hands-free device to remote control electronic devices, but may also be applied to one hands-free type electronic device configured by combining various electronic device functions and a hands-free function.

The present invention has been described with respect to the specific embodiments.

However, it will be apparent to those skilled in the art that various changes and modifications may be made without departing from the spirit and scope of the invention as defined in the following claims.

What is claimed is:

1. A hands-free device comprising:

an earphone;

a hands-free main body;

a control unit mounted in the hands-free main body and configured to apply an operation signal; and an earphone protruding unit formed in the hands-free main body and configured to protrude the earphone through a rear surface of the hands-free main body in response to a protrusion operation signal of the control unit, wherein the earphone protruding unit comprises:

a protrusion guide portion formed horizontally inside the hands-free main body and having rails formed in a longitudinal direction thereof;

a protrusion movement block having a bottom part coupled to the protrusion guide portion so as to linearly move and a top part coupled to an earphone boss portion; and a horizontal driving unit formed at the bottom part of the protrusion movement block and configured to receive the protrusion operation signal of the control unit and apply a linear moving force to the protrusion movement block.

2. The hands-free device of claim 1, wherein the hands-free main body has an earphone protrusion hole formed in the rear surface thereof, through which the earphone is protruded.

3. The hands-free device of claim 1, wherein the top part of the protrusion guide portion is opened to form a housing space, the rails are formed to extend horizontally while facing each other inward from both side surfaces, the bottom part of the protrusion guide portion is housed in the housing space, and the protrusion guide portion has rail grooves formed in side surfaces thereof, into which the rails are inserted to linearly move the protrusion movement block while restricting the protrusion movement block from moving upward.

4. The hands-free device of claim 1, wherein the horizontal driving unit comprises:

a motor having a rotating shaft inserted horizontally inside the bottom part, of the protrusion movement block;

a rotating rod having one end coupled to the motor shaft and the other end rotatably supported by the bottom inside of the protrusion movement block;

a pinion gear having a central portion coupled to the rotating rod so as to transmit torque of the motor; and a horizontal rack bar formed on the bottom surface of the protrusion guide portion and engaged with the pinion gear so as to convert the rotation of the motor into a linear movement.

5. The hands-free device of claim 4, wherein the pinion gear has gear teeth formed to protrude downward from the bottom of the protrusion movement block.

6. The hands-free device of claim 1, wherein a decoration unit is detachably coupled to a front surface of the hands-free main body.

7. The hands-free device of claim 1, wherein a coupling unit is detachably coupled to one side of the hands-free main body.

8. A hands-free device comprising:

an earphone;

a hands-free main body, wherein the earphone is securely mounted on a portion of the hands-free main body and coupled to the hands-free main body by a wire;

a control unit mounted in the hands-free main body and configured to apply an operation signal to a driving unit, wherein the operation signal includes at least one of a protrusion operation signal, a draw operation signal and an extension operation signal and wherein a moving object is driven by the driving unit; and an earphone protruding unit including the driving unit formed in the hands-free main body and configured to protrude the earphone from the hands-free main body in response to the operation signal from the control unit, wherein the earphone protruding unit includes the moving object which is moved with the earphone in response to the operation signal.

9. The hands-free device of claim 8, wherein the hands-free main body includes a rear surface and wherein the hands-free device further comprises a drawing unit configured to draw the earphone through the rear surface of the hands-free main body in response to the drawing operation signal of the control unit.

10. The hands-free device of claim 8, wherein the hands-free main body includes top and bottom surfaces, one or more of which are formed to be opened and wherein the hands-free device further comprises a drawing unit configured to draw the earphone through one or more of the top and bottom surfaces of the hands-free main body in response to the drawing operation signal of the control unit.

* * * * *